US006836269B2

(12) United States Patent
Maeda et al.

(10) Patent No.: US 6,836,269 B2
(45) Date of Patent: Dec. 28, 2004

(54) PRECHARGE CIRCUIT AND IMAGE DISPLAY DEVICE USING THE SAME

(75) Inventors: Kazuhiro Maeda, Nara (JP); Hajime Washio, Tenri (JP); Yasushi Kubota, Sakurai (JP); Yasuyoshi Kaise, Tenri (JP); Michael James Brownlow, Oxford (GB); Graham Andrew Cairns, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 199 days.

(21) Appl. No.: 09/795,658

(22) Filed: Feb. 28, 2001

(65) Prior Publication Data

US 2003/0030616 A1 Feb. 13, 2003

(30) Foreign Application Priority Data

Feb. 28, 2000 (JP) ..... 2000-052410
Feb. 22, 2001 (JP) ..... 2001-047368

(51) Int. Cl.[7] ..... G09G 5/00
(52) U.S. Cl. ..... 345/212; 345/87
(58) Field of Search ..... 345/87–104, 204–214, 345/690–699; 327/530, 531, 540; 323/217, 901, 213, 242, 243, 244

(56) References Cited

U.S. PATENT DOCUMENTS 5,617,111 A * 4/1997 Saitoh ..... 345/100
5,726,676 A * 3/1998 Callahan et al. ..... 345/98
5,959,600 A * 9/1999 Uchino et al. ..... 345/94
6,281,826 B1 * 8/2001 Kimura ..... 341/150
6,300,927 B1 * 10/2001 Kubota et al. ..... 345/92
6,307,681 B1 * 10/2001 Aoki et al. ..... 359/645
6,313,819 B1 * 11/2001 Maekawa et al. ..... 345/92
6,417,847 B1 * 7/2002 Mametsuka ..... 345/213
6,529,180 B1 * 3/2003 Ito et al. ..... 345/89
6,531,996 B1 * 3/2003 Murade ..... 345/98
6,559,824 B1 * 5/2003 Kubota et al. ..... 345/100
2001/0010511 A1 * 8/2001 Uchino et al. ..... 345/87

FOREIGN PATENT DOCUMENTS

| | | |
|---|---|---|
| EP | 0 821 491 A1 | 1/1998 |
| JP | 07-114432 | 5/1995 |
| JP | 07-121139 | 5/1995 |
| JP | 07-295521 | 11/1995 |
| JP | 08-286639 | 11/1996 |
| JP | 09-197369 | 7/1997 |
| JP | 10 096958 | 4/1998 |
| JP | 2000-52410 | 2/2000 |
| TW | 354865 | 3/1999 |

OTHER PUBLICATIONS

Saito, et al., "A 6–bit Digital Data Driver for color TFT–L-CDs", 298 NEC Research & Development vol. 36, No. 4, Oct. 1995, JP, pp. 485–492.

Matsueda, et al., "30.1: A 6–bit color VGA Low–Temperature Poly–Si TFT–LCD with IntegratedDigital Data Drivers", SID 98 Digest, vol. 29 (May 17, 1998), pp. 879–882.

* cited by examiner

*Primary Examiner*—Chanh Nguyen
(74) *Attorney, Agent, or Firm*—David G. Conlin; William J. Daley, Jr.; Edwards & Angell, LLP

(57) ABSTRACT

A precharge control circuit constituted by (1) a latch circuit mounted in a precharge circuit and (2) a level shifter circuit of a current drive type controlled through an output of the latch circuit is included. The precharge control circuit changes the latch circuit to an active state to cause the level shifter circuit of a current drive type to operate only during a precharge period and also during immediately preceding and succeeding periods, and outside these periods, changes the latch circuit in a non-active state and the level shifter circuit of a current drive type in an operating state to save power consumption in the level shifter circuit. This enables a low-power-consuming precharge circuit, as well as a low-power-consuming image display device with a high quality display capability, to be offered.

15 Claims, 29 Drawing Sheets

PRECHARGE CIRCUIT AND IMAGE DISPLAY DEVICE USING THE SAME

FIELD OF THE INVENTION

The present invention relates to precharge circuits for precharging a signal line by applying a predetermined voltage before applying an image signal to the signal line and also to image display devices using the same.

BACKGROUND OF THE INVENTION

The liquid crystal display device of an active matrix drive type is one of well-known conventional image display devices. The liquid crystal display device is, as FIG. 36, constituted by a pixel array ARY, a scan signal line drive circuit GD, a data signal line drive circuit SD, and a precharge circuit PC. The pixel array includes numerous scan signal lines GL (GL1 to GLj; will be referred collectively to GL) and data signal lines SL (SL1 to SLj; will be referred collectively to SL) crossing each other and pixels PIX which are located in individual segments surrounded by two adjacent scan lines GL and two adjacent data signal lines SL and arranged in a matrix.

The data signal line drive circuit SD samples the incoming video signal DAT in synchronism with an externally provided clock signal CKS and other timing signals, amplifies the samples as required, and writes them to the data signal lines SL. The scan signal line drive circuit GD sequentially selects the scan signal lines GL in synchronism with a clock signal CKG and other timing signals and controls the opening/closing of the switching elements in the pixels PIX, thereby writing to the pixels PIX the video signal (data) written to the data signal lines SL as explained above and causing the data written to the pixels PIX to be held.

The precharge circuit PC writes a precharge voltage across the data signal lines during a period (precharge period) which comes before the data signal line drive circuit SD writes data to the data signal lines SL and in which the scan signal line drive circuit GD selects no scan line GL, in response to externally supplied precharge control signals PCTL, PCTLB, etc. as disclosed in Japanese Laid-Open Patent Application No. 7-295521/1995 (Tokukaihei 7-295521; published Nov. 10, 1995). Thereby, charge and discharge are reduced during the writing of data to the data signal line SL by the data signal line drive circuit SD, and fluctuations in the potential of the image signal line (data signal line) are restrained.

In the liquid crystal display device as mentioned above, control and other kinds of signals (clock signals CKS/CKG, start signals SPS/SPG, precharge control signal PCTL, etc.) are externally provided directly to the data signal line drive circuit SD, the scan signal line drive circuit GD, and a precharge circuit PC with the same amplitude as the power supply voltage (VDD) of the respective circuits.

Meanwhile, in recent years, technologies whereby the pixel array ARY and drive circuits SD and GD, instead of being fabricated on separate integrated circuit chips and mounted on a panel afterwards, are integrated on a panel on which the pixel array ARY is fabricated have caught wide interest for the purposes of miniaturisation, resolution improvement, and packaging cost reduction of the liquid crystal display device. In the liquid crystal display device with a built-in drive circuit, the substrate needs to be transparent (when used as a component in a transparent liquid crystal display device that is now widely used), and therefore, polycrystalline silicon thin film transistors, which can be formed on a quartz or glass substrate, are often used as active elements.

Incidentally, the liquid crystal display device with a built-in drive circuit employing polycrystalline silicon thin film transistors exhibits inferior transistor characteristics to monocrystalline silicon transistors fabricated from the aforementioned integrated circuit chips. Particularly, the absolute value of the threshold voltage is as high as 1V to 6V, which inevitably increases the drive power supply voltage to a high value around 15V to 20V.

Under these circumstances, externally supplied control signal and the like need to have a large amplitude too. This would cause power consumption in external circuits such as a control circuit for producing a control signal. Another resultant big problem would be undesirable radiation from signal lines. Accordingly, a suggestion is made to solve these problems by mounting a signal voltage booster circuit (level shifter circuit) on the circuit side of the liquid crystal display device to fill in the requirement for the aforementioned high drive power supply voltage VDD in the panel, while maintaining the low voltage across the input/output interface.

SUMMARY OF THE INVENTION

The present invention has an object to provide a precharge circuit with a capability to reduce power consumption and also to provide an image display device with a capability to reduce in size and mounting costs and improve resolution by incorporating the precharge circuit.

A precharge circuit in accordance with the present invention, in order to accomplish the object, is for precharging a signal line to a predetermined voltage before applying a video signal to the signal line and is characterized by the following arrangement.

The precharge circuit is characterised in that it includes a precharge control circuit which operates during a shorter period, encompassing a precharge period not coinciding with a drive period of the signal line, than an effective display period in a horizontal period and which effects such control to output the predetermined voltage.

According to the invention, after the signal line is precharged to a predetermined voltage, a video signal is applied to the signal line.

Conventionally, the precharge circuit operates throughout the time. A constant current flows in the precharge circuit even during non-precharge periods as long as the precharge circuit is operating, which results in an increase of power consumption in the precharge circuit.

In contrast, in the present invention, a precharge control circuit is provided which operates during a shorter period, encompassing a precharge period not coinciding with a drive period of the signal line, than an effective display period in a horizontal period; therefore, the precharge voltage is output only during active periods of the precharge circuit. Due to this control, the constant current no longer flows in the precharge circuit during non-active periods. Power consumption is limited only to active periods, which restrains increases in power consumption in the precharge circuit with corresponding certainty.

Preferably, the precharge control circuit controls the precharging based on an externally supplied, low-amplitude external input signal which has an amplitude lower than that of a drive voltage of the precharge circuit and which maintains the amplitude during the precharge period.

In this event, an external circuit only needs to supply to the precharge control circuit an external input signal with an amplitude lower than that of a drive voltage of the precharge circuit, thereby enabling the load and power consumption in the external circuit to be reduced. This ensures the provision of a low voltage interface.

Preferably, the precharge control circuit includes a level shifter circuit, which is activated during a period in which an input of the low-amplitude external input signal is required, for level-shifting the low-amplitude external input signal.

In this event, the level shifter circuit becomes active during the precharge period and the period during which an input of the low-amplitude external input signal is required; therefore, it is ensured that the precharging is controllable only during the precharge period based on the external input signal with an amplitude lower than that of the drive voltage of the precharge circuit.

Preferably, the level shifter circuit is of a current drive type. Level shifter circuits can be divided into two major categories: voltage drive type and current drive type. The voltage drive type does not require a constant current and therefore boasts low power consumption. However, its operation is dictated by threshold values of the switching elements included in the circuit, and the operation margin for switching element characteristics is narrow. The current drive type requires a constant current and therefore has a disadvantage of relatively large power consumption. However, it has an advantage of a wide operation margin for the characteristics of the switching elements included in the circuit. For instance, the polycrystalline properties render it difficult to impart uniform threshold values and movability to all the transistors in the circuit. Therefore, the use of a level shifter circuit of a current drive type solve these problems, because it offers a wide operation margin.

For a fuller understanding of the nature and advantages of the invention, reference should be made to the ensuing detailed description taken in conjunction with the accompanying drawings.

BRIEF DESCRIPTION OF THE DRAWINGS

FIG. 25(*d*) is a waveform diagram showing a precharge voltage when the precharge voltage is produced based on a horizontally synchronized signal or a vertically synchronized signal in the arrangement of FIG. 22.

FIG. 28(*b*) is a drawing showing, as an example, timings of operation of an internal node when the precharge control circuit of FIG. 9 is mounted.

FIG. 28(*c*) is a drawing showing, as an example, timings of operation of an internal node when the precharge control circuit of FIG. 17 is mounted.

DESCRIPTION OF THE EMBODIMENTS

Referring to FIG. 1 to FIG. 35, the following description will discuss an embodiment in accordance with the present invention. Here, a liquid crystal display device and a precharge circuit for applying a predetermined voltage to its data signal line during a precharge period will be explained as an image display device and a precharge circuit that represent the field of technology of interest in the present invention. However, the present invention is by no means limited to this embodiment and is also applicable to other image display devices and precharge circuits.

Figure 1:
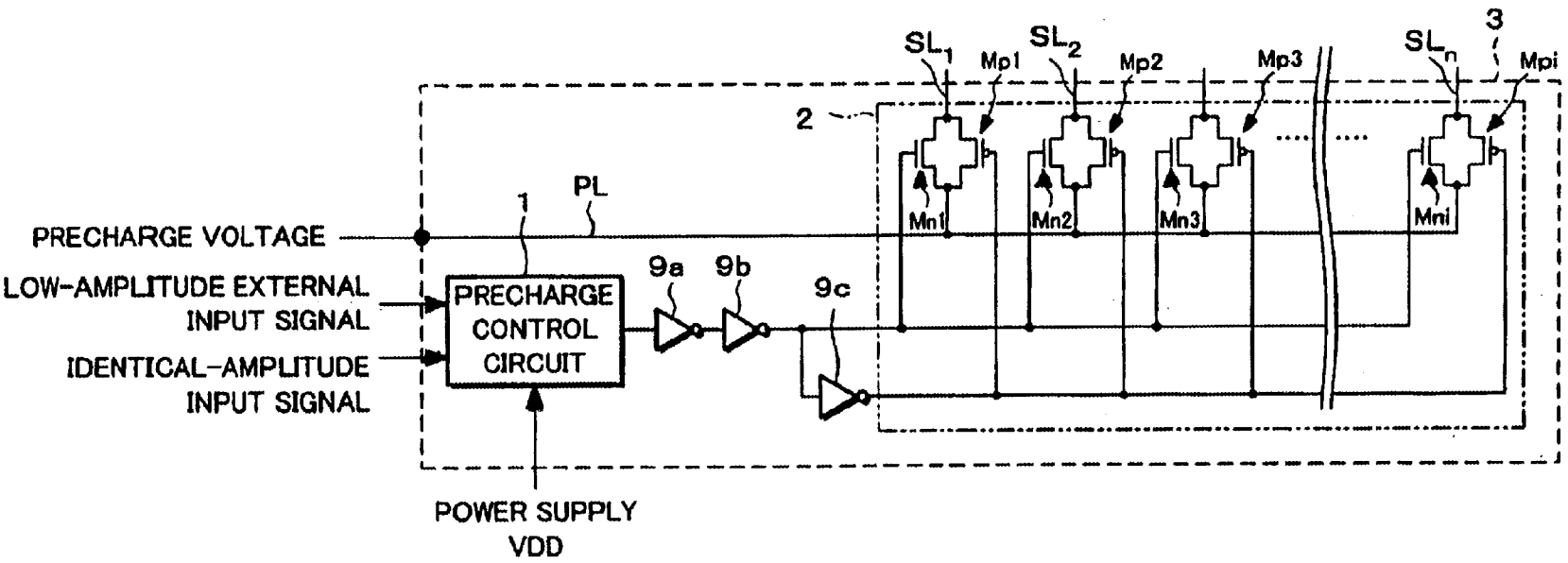
FIG. 1 is a block diagram showing, as an example, an arrangement of a precharge circuit in accordance with the present invention.

FIG. 1 is a block diagram showing, as an example, an arrangement of a precharge circuit 3 in accordance with the present invention. As shown in FIG. 1, the precharge circuit 3 includes a sampling switch 2 and a precharge control circuit 1 as primary components. The precharge control circuit 1 receives a power supply VDD; a signal, produced in the panel, with an amplitude identical to that of the power supply VDD (identical-amplitude input signal); and a signal, supplied externally to the panel, with an amplitude lower than that of the power supply VDD (low-amplitude external input signal). The sampling switch 2 receives a precharge voltage (detailed later) to control, based on instructions from the precharge control circuit 1, conductance and a cut-off between output line PL to which a precharge voltage is applied and signal lines SL1 to SLn to which a precharge voltage is applied during a precharge period.

The precharge control circuit 1 is activated and deactivated through the control of the identical-amplitude input signal. When it is activated, the sampling switch 2 is controlled by an output signal obtained by boosting the voltage of the low-amplitude external input signal to a level equal to that of the power supply VDD. This enables the precharge circuit 3 to operate only during chosen periods and thereby consume less electric power.

Figure 2:
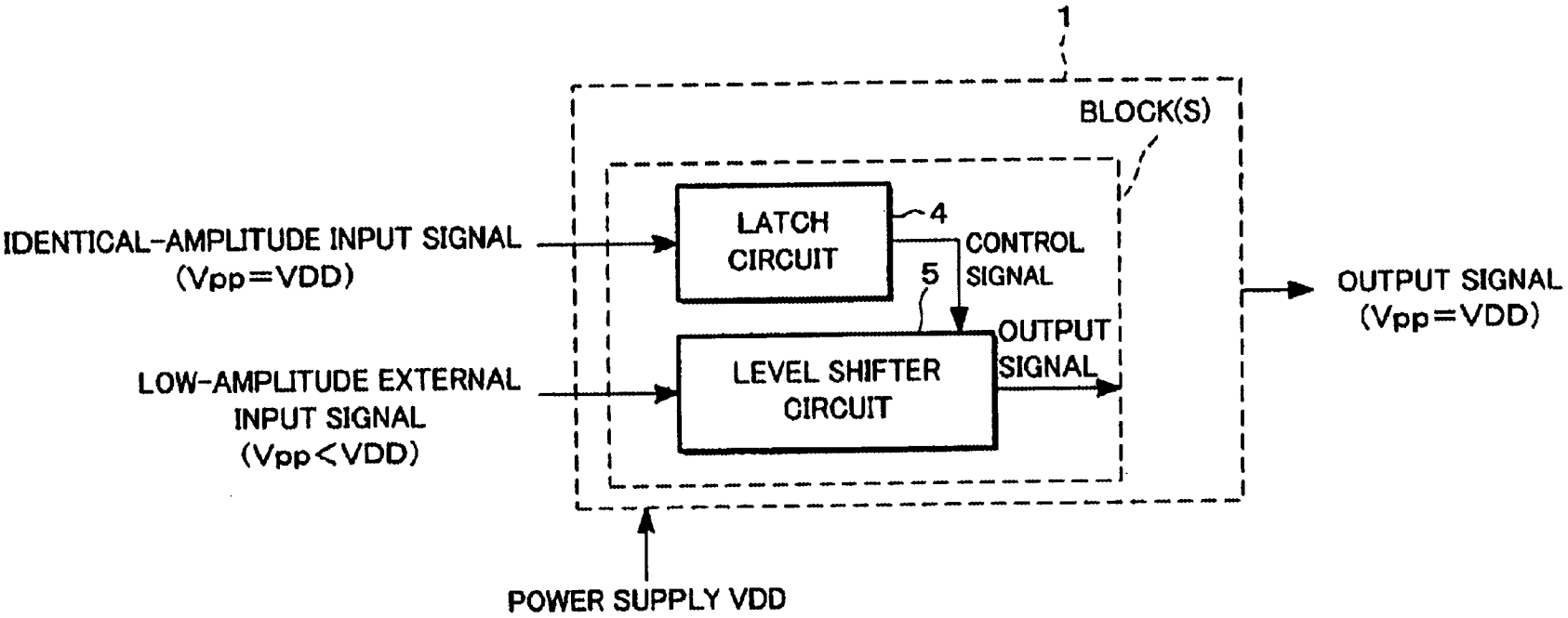
FIG. 2 is a block diagram showing, as an example, an arrangement of a precharge control circuit incorporated in the precharge circuit of FIG. 1.

FIG. 2 is a block diagram showing, as an example, an arrangement of a precharge control circuit 1 incorporated in the precharge circuit 3. In FIG. 2, the precharge control circuit 1 is constituted by one or more unitary blocks each of which includes a latch circuit 4 for switching between states in response to the identical-amplitude input signal and holding the precharge control circuit 1 in the switched state and a level shifter circuit 5 that is switchable between active and non-active states in response to an output from the latch circuit 4.

The provision of the latch circuit 4 allows the use of a signal whose active period is shorter than a specific precharge circuit operating period encompassing the precharge period as the identical-amplitude input signal that is supplied to the precharge control circuit 1 to dictate the operation/non-operation of the precharge circuit 3. In this manner, the control of the precharge circuit 3 is effected, as detailed later, through a signal that is originally existent in the liquid crystal panel. Also, a combination of two or more blocks will reduce the number of the input signal externally supplied to the precharge circuit 3.

Figure 3:
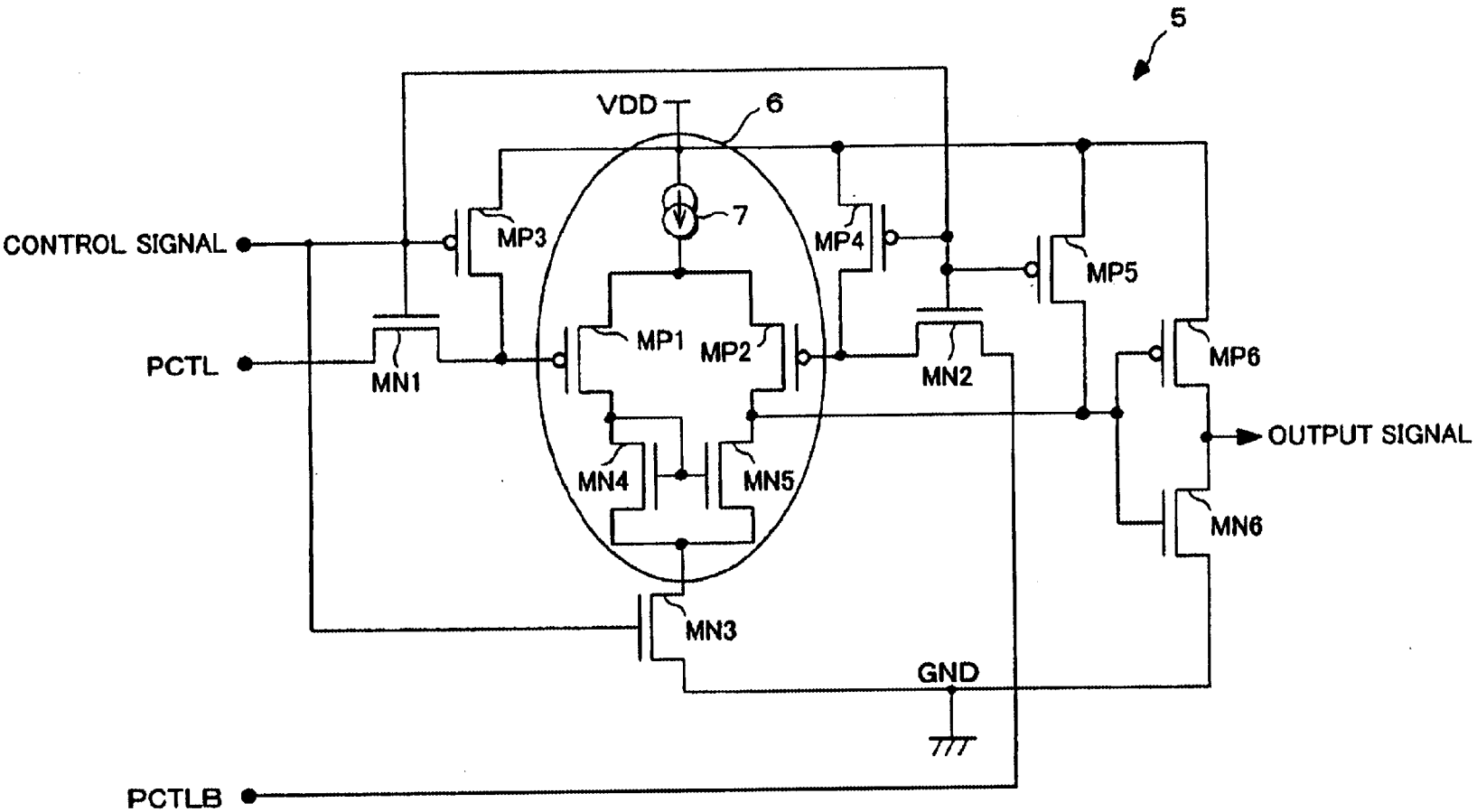
FIG. 3 is a drawing showing, as an example, an arrangement of a level shifter circuit incorporated in the precharge control circuit of FIG. 2.

FIG. 3 is a circuit diagram showing, as an example, an arrangement of a level shifter circuit 5 incorporated in the precharge control circuit 1 in the precharge circuit 3. The level shifter circuit 5 of FIG. 3 is basically of a differential amplifier type, and its basic operations include to supply an output signal whose amplitude is almost identical to that of the drive voltage VDD for the level shifter circuit 5 in synchronism with an input signal PCTL/PCTLB to the gates of MP1 and MP2 (P-type MOSFETs) that act as the input section for the differential amplifier circuit section 6.

Here, the level shifter circuit 5 of FIG. 3 includes MN1 and MN2 located between the signal input terminals of the PCTL/PCTLB and the gates of MP1 and MP2 that act as input section for the differential amplifier circuit section 6, as well as MN3 located between GND and the differential amplifier circuit section 6 (MN1 to MN3 are all N-type MOSFETs), as switches to control the operation of the circuit. To remain in a stable state during non-active periods, the level shifter circuit 5 further includes pull-up switches MP3, MP4, and MP5 (P-type MOSFETs) between the gates of MP1 and MP2 that float in a non-active state, the output node of the differential amplifier circuit section 6, and the power supply VDD.

All the switches MN1, MN2, MN3, MP3, MP4, and MP5 receive at their gates a control signal $\phi$ produced in the panel as the identical-amplitude input signal which has an identical amplitude to that of the power supply VDD. If the control signal $\phi$ is high level (active), the pull-up switches MP3, MP4, and MP5 turn off, while the switches MN1, MN2, and MN3 for controlling the operation of the circuit turn on. This enables the level shifter circuit 5 to operate.

In contrast, if the control signal $\phi$ is low (non-active), the pull-up switches MP3, MP4, and MP5 turn on, while the switches MN1, MN2, and MN3 for controlling the operation of the circuit turn off. This disconnects the differential amplifier circuit section 6 including a constant current source 7 in an active state from GND and causes the gates of MP1 and MP2 to be pulled up to VDD; therefore, no current passes through the differential amplifier circuit section 6. Further, here, since the output node of the differential amplifier circuit section 6 is also pulled up to the power supply VDD, upon the turning on of MN6, the output of the level shifter circuit 5 is clamped to low.

Figure 4:
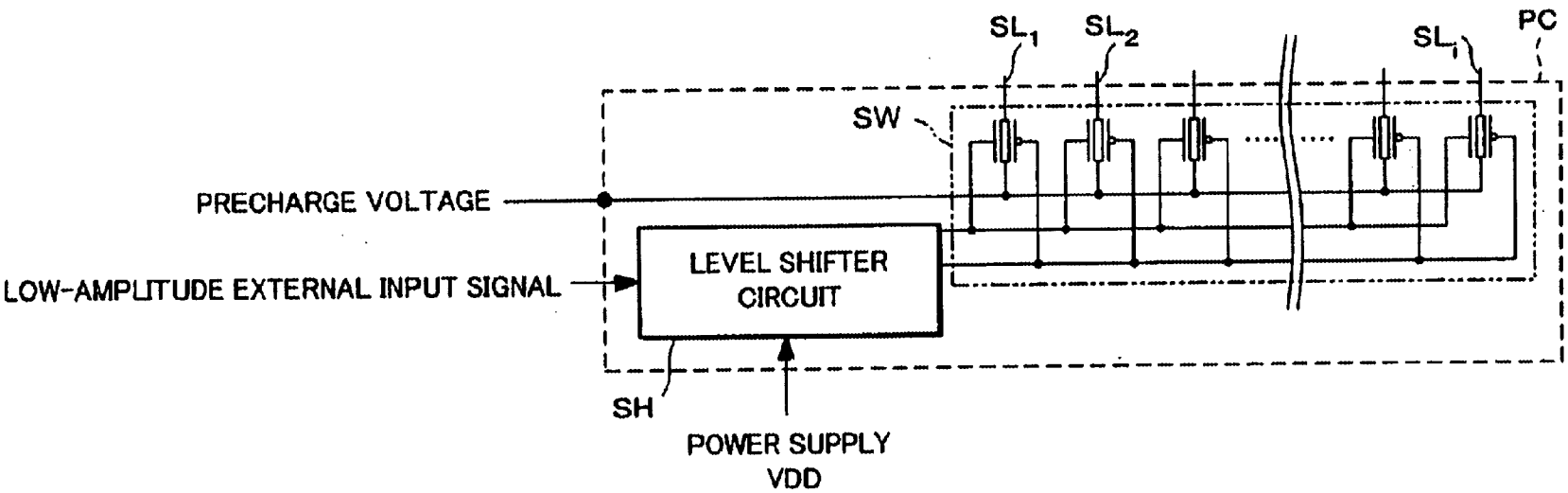
FIG. 4 is a block diagram showing, as an example, an arrangement of a precharge circuit as a comparative example of the present invention.

Here, FIG. 4 shows, as an comparative example, an arrangement of a precharge circuit to which a permanently operating level shifter circuit of a current drive type is mounted. In the circuit of FIG. 4, a level shifter circuit, SH, of a current drive type is disposed immediately before a sampling switch SW for sampling precharge voltages to apply to data signal lines SL, and the sampling switch SW is driven by a high drive voltage VDD available in the panel as a result of boosting the voltage of a signal (low-amplitude external input signal) supplied external to the panel with an amplitude lower than that of the power supply VDD. A setback, however, in mounting a level shifter of a current drive type in this manner is the constant current produced by the constant current source 7 and the like throughout the time including precharge periods, resulting in increased power consumption.

In contrast, the arrangement of FIGS. 1 to 3 enables the level shifter 5 to operate only during chosen periods and thereby ensures reductions in power consumption in the precharge circuit 3. It should be noted in FIG. 3 that both PCTL and PCTLB are precharge control signals which are both low-amplitude external input signals.

Figure 5:
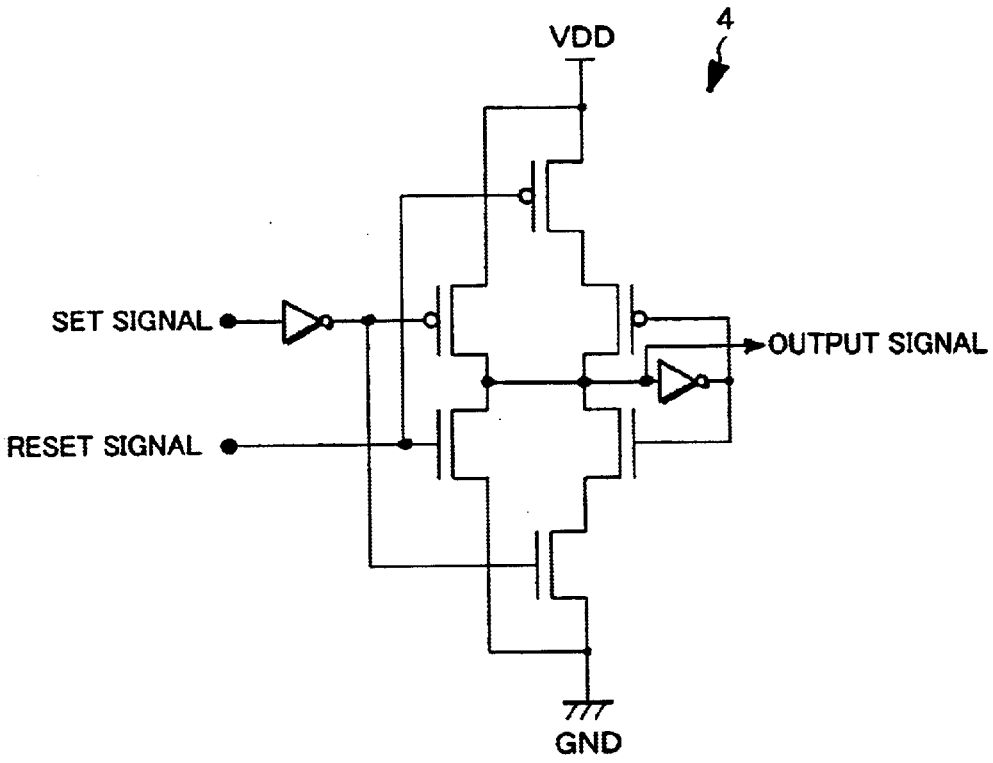
FIG. 5 is a drawing showing, as an example, an arrangement of a latch circuit incorporated in the precharge control circuit of FIG. 2.

FIG. 5 is a circuit diagram showing an arrangement of a latch circuit 4 incorporated in the precharge control circuit 1 in the precharge circuit 3. Being an SR flip-flop (set-reset type flip-flop), the latch circuit 4 changes its output according to incoming set and reset signals.

Figure 6:
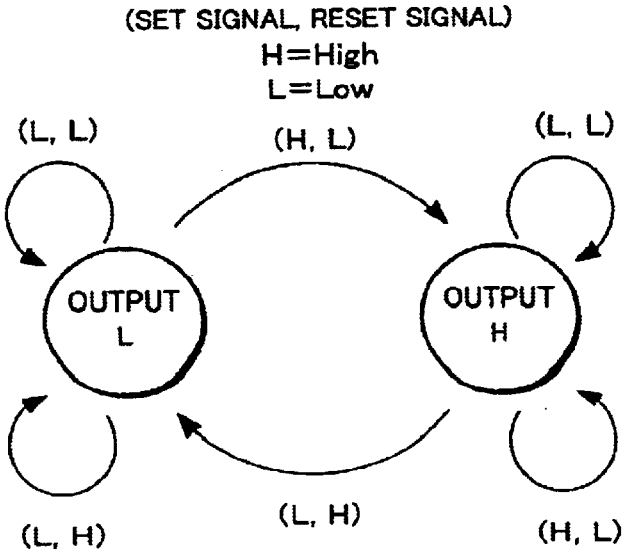
FIG. 6 is a drawing showing switching of states of the latch circuit of FIG. 5.

FIG. 6 shows the switching of the output signal in response to the input signals. Hereinafter, a notation of "(Set Signal State, Reset Signal State)" will be used, and H and L will represent a high level and a low level respectively. If the output in the initial state is L, the output changes from L to H in response to (H, L). Then, the output remains at H in response to (H, L) or (L, L) and changes from H to L in response to (L, H). In the latter case, the output then remains at L in response to (L, H) or (L, L). The combination of (H, H) is forbidden here.

Figure 7:
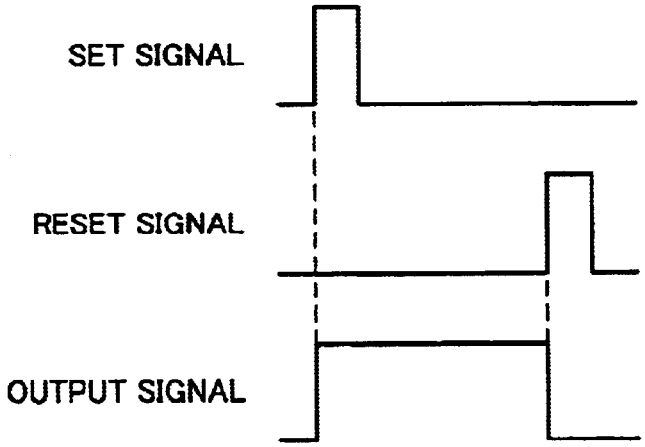
FIG. 7 is a drawing showing, as an example, timings of operations of the latch circuit of FIG. 5.
Figure 8:
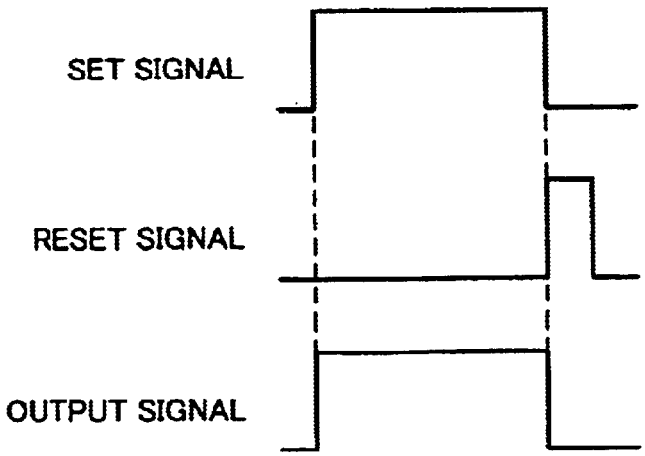
FIG. 8 is a drawing showing, as an example, other timings of operations of the latch circuit of FIG. 5.

FIGS. 7 and 8 show timings of actual operations of the circuit. The output signal changes from L to H upon the set signal changing from L to H, and then remains at H until (L, H) is reached. In other words, the output signal changes from H to L upon the set signal changing from H to L and the reset signal subsequently changing from L to H as shown in FIG. 7 or upon the set and reset signals simultaneously changing from H to L and from L to H respectively as shown in FIG. 8. Thereafter, the output signal remains at L until the set signal again changes from L to H.

The arrangement discussed above enables the precharge circuit 3 to operate only during chosen periods by the use of the set signal and the reset signal. In addition, the use of the latch circuit 4 allows a signal with an arbitrary H period to be used as the set and reset signals, provided that the set and rest signals: (1) flank a precharge period between their rising periods; and (2) do not share a common H period. This enables the use of a signal that is originally existent in the liquid crystal panel as detailed later. Another advantage is that there is no need to increase the number of signals externally supplied to the liquid crystal panel.

Figure 9:
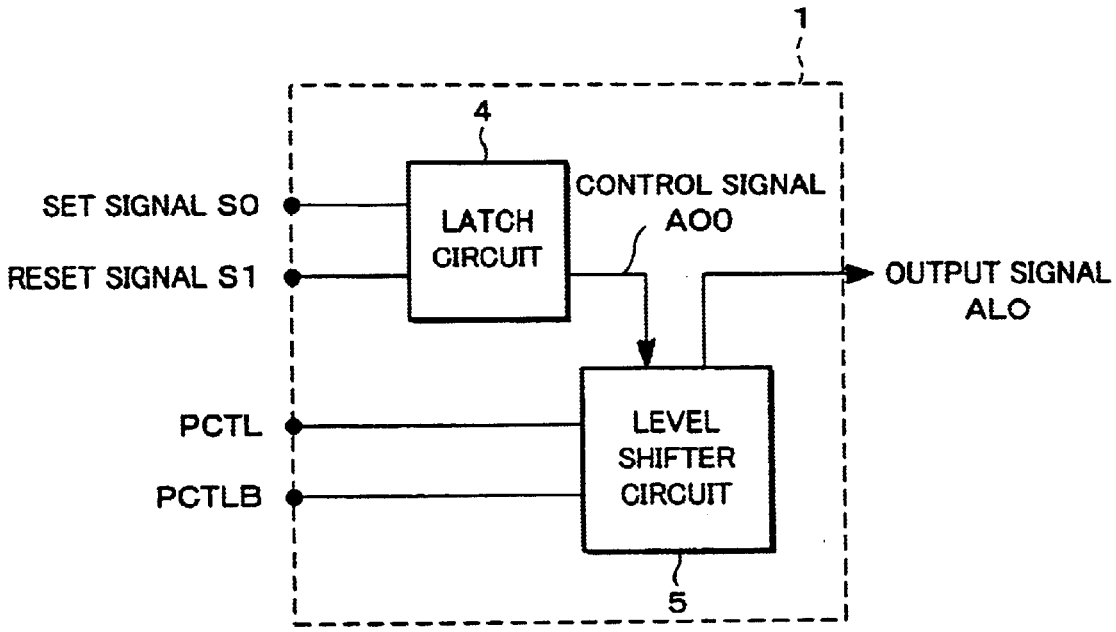
FIG. 9 is a block diagram showing, as an example, an arrangement of the precharge control circuit of FIG. 2 when the latch circuit of FIG. 5 is used.

FIG. 9 is a block diagram showing a specific arrangement of the precharge control circuit 1 which realize the precharge circuit 3 by the use of the latch circuit 4 of FIG. 5. In FIG. 9, the latch circuit 4 is identical to the RS flip-flop of FIG. 5, and the level shifter circuit 5 of a current drive type is identical to that of FIG. 3. In this precharge circuit 1, a set signal S0 and a reset signal S1 are used as the foregoing signals that (1) flank a precharge period between their rising periods; and (2) do not share a common H period. the level shifter circuit 5 is caused to operate only during a specific period encompassing the precharge period by using, as a control signal to control the level shifter circuit 5, the output AO0 from the latch circuit 4 controlled through the set signal S0 and the reset signal S1 (1). Consequently, the level shifter circuit 5 outputs a signal ALO obtained by boosting the voltage of a precharge control signal PCTL or a precharge control signal PCTLB. Therefore, current consumption in the precharge circuit 3 is reduced in comparison with a case where the level shifter circuit 5 is caused to operate throughout the time. The signals S0 and S1 correspond to the identical-amplitude input signal which is produced in the panel with an identical amplitude as the source supply VDD to control the precharge control circuit 1 and will be discussed later in detail. Corresponding to the low-amplitude external input signal, the precharge control signals PCTL and PCTLB are supplied external to the panel and specify a precharge period with an amplitude lower than that of the source supply VDD.

Figure 10:
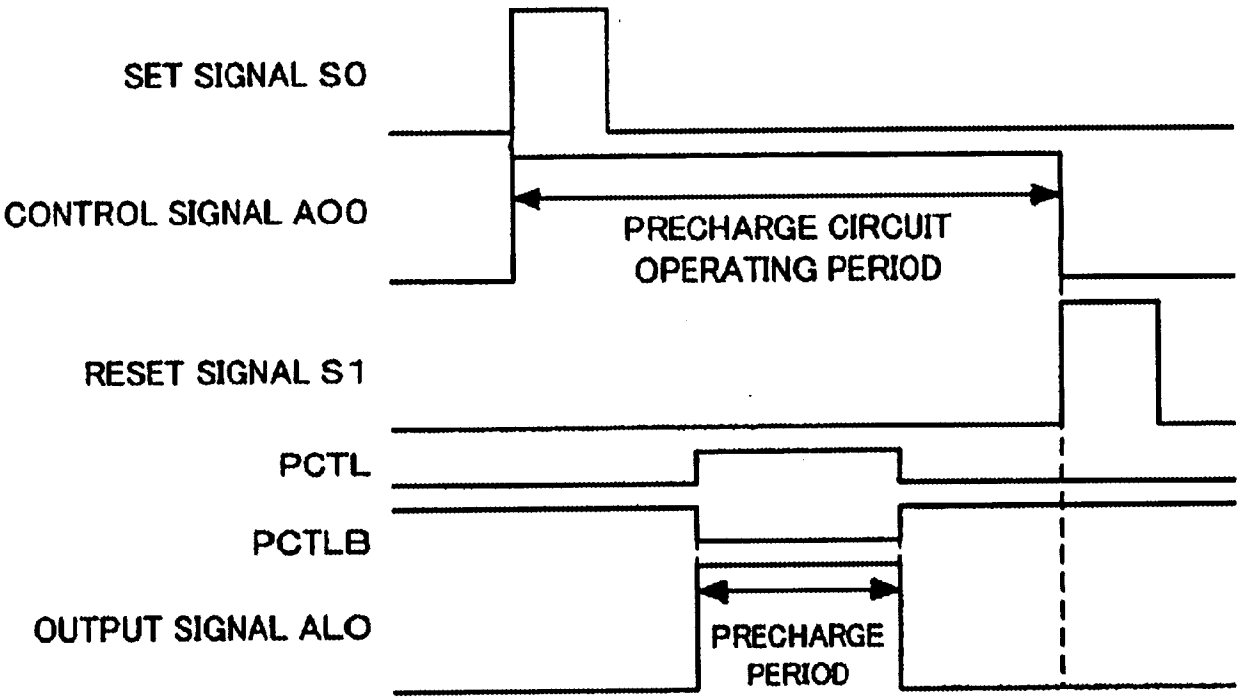
FIG. 10 is a drawing showing, as an example, timings of operations of the precharge control circuit of FIG. 9.

FIG. 10 shows timings of operations of the precharge control circuit 1 of FIG. 9. The set signal S0 changes the latch circuit 4 from a non-active state to an active state and changes the control signal AO0 from L to H. During the period in which the control signal AO0 is H, the level shifter circuit 5 whose activation/deactivation is controlled through the control signal AO0 remains in an active state and outputs an output ALO obtained by boosting the voltage of the externally provided, low-amplitude precharge control signal PCTL or precharge control signal PCTLB to substantially the same amplitude as that of the drive voltage for the precharge circuit 3. Thereafter, the reset signal S1 deactivates the latch circuit 4 and changes the control signal AO0 from H to L, and the level shifter circuit 5 is deactivated.

In this series of operations, constant current occurs only during the precharge circuit operating period of FIG. 10, which ensures reductions in current consumption as compared with an comparative example shown in FIG. 4 in which the precharge circuit operates throughout the time.

Figure 11:
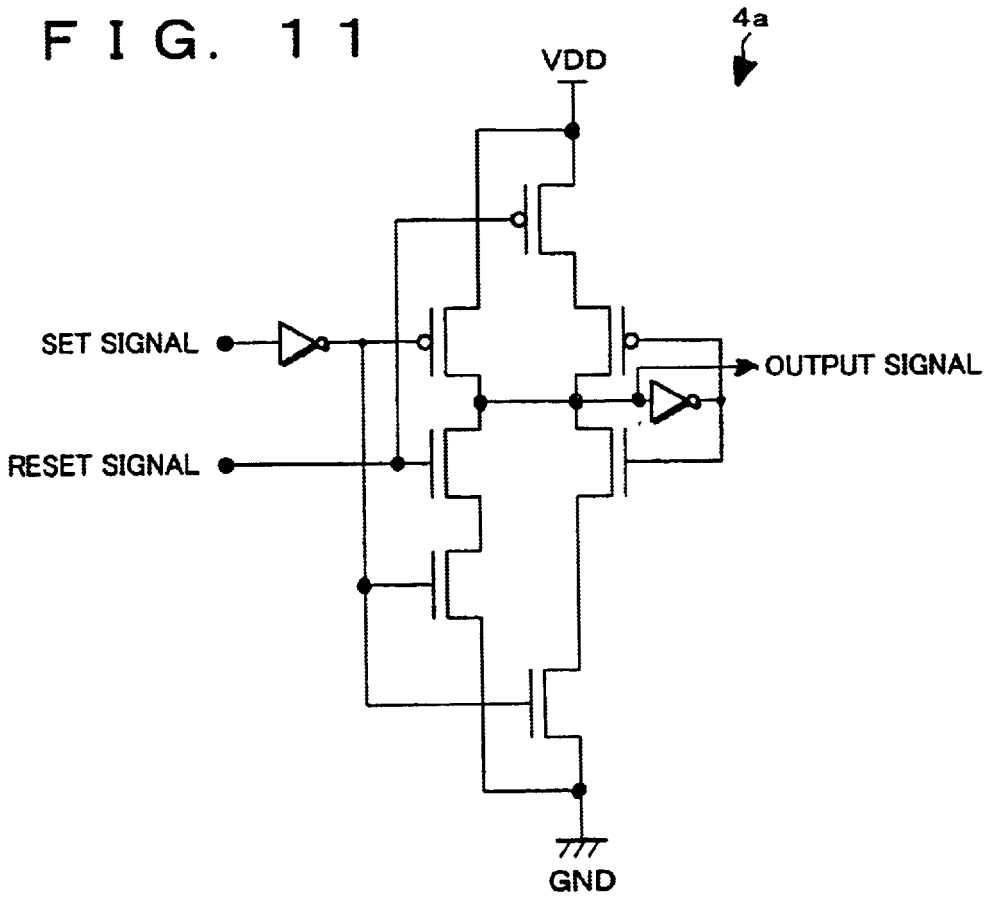
FIG. 11 is a drawing showing, as an example, another arrangement of the latch circuit incorporated in the precharge control circuit of FIG. 2.
Figure 12:
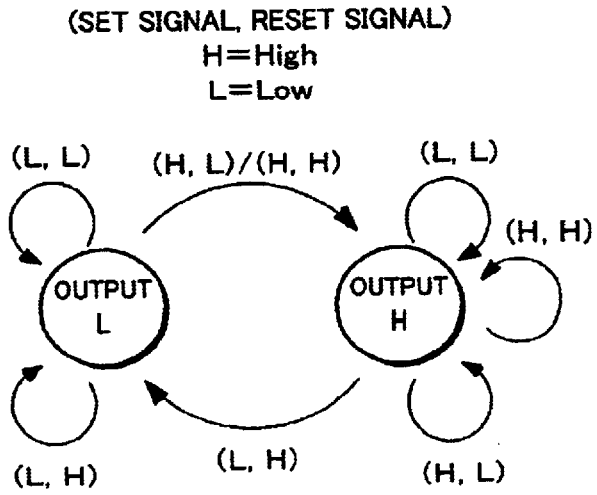
FIG. 12 is a drawing showing switching of states of the latch circuit of FIG. 11.

FIG. 11 is a circuit diagram showing, as an example, an arrangement of another latch circuit 4*a* incorporated in the precharge control circuit 1 in the precharge circuit 3. Being a set-overwrite-reset type flip-flop, the latch circuit 4*a* of FIG. 11 changes its output according to the incoming set and reset signals. FIG. 12 shows the switching of the output signal in response to the input signal.

Hereinafter, a notation of "(Set Signal State, Reset Signal State)" will be used similarly to the case of FIG. 6. If the output of the latch circuit 4*a* is L in the initial state, the output changes from L; to H in response to (H, L) or (H, H). Then, the output remains at H in response to (H, L), (H, H), or (L, L) and changes from H to L in response to (L, H). In the latter case, the output then remains at L in response to (L, H) or (L, L).

Figure 13:
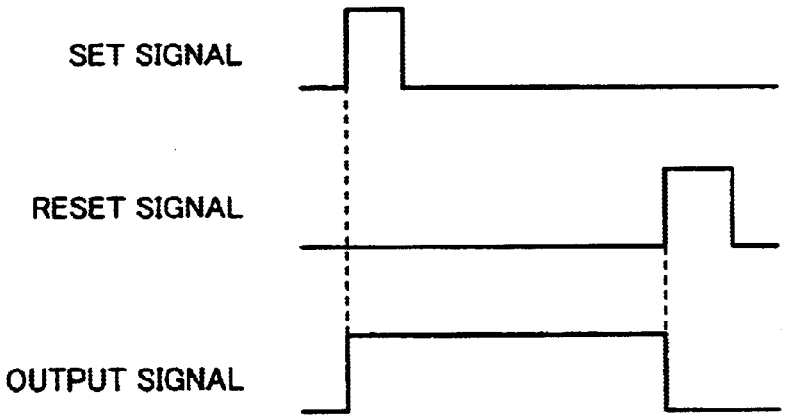
FIG. 13 is a drawing showing, as an example, timings of operations of the latch circuit of FIG. 11.
Figure 14:
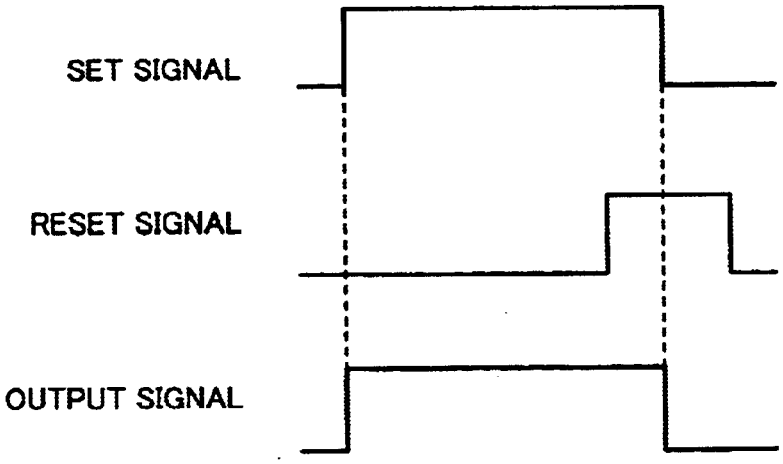
FIG. 14 is a drawing showing, as an example, other timings of operations of the latch circuit of FIG. 11.

FIGS. 13 and 14 show timings of actual operations of the circuit. The output signal changes from L to H upon the set signal changing from L to H, and then remains at H until (L, H). That is, the output signal changes from H to L either upon the reset signal changing from L to H which takes place after the set signal changing from H to L or upon the set signal changing from H to L which takes place after the reset signal changing from L to H. Thereafter, the output signal remains at L until the set signal again changes from L to H.

According to the arrangement discussed above, in the arrangement of FIG. 11, the (H, H) signal assumes a tolerable pattern as compared with the case of FIG. 5, and two signals that share a common H period can be used as set and reset signals.

Figure 15:
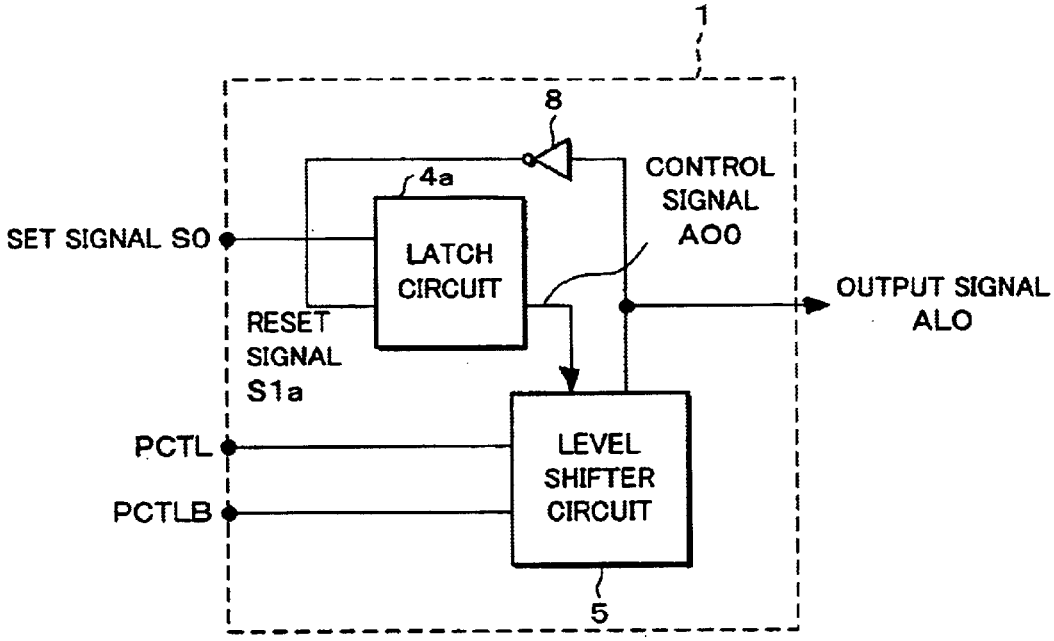
FIG. 15 is a block diagram showing, as a modified example, an arrangement of the precharge control circuit of FIG. 2 when the latch circuit of FIG. 11 is used.

FIG. 15 is a block diagram showing another arrangement of the precharge control circuit 1 in the precharge circuit 3. The example here includes a latch circuit 4*a* constituted by the aforementioned set-overwrite-reset type flip-flop of FIG. 11 and a level shifter circuit 5 discussed in the foregoing example. An output ALO obtained by boosting the voltage in the level shifter circuit 5 of a current drive type is fed to the latch circuit 4*a* as a reset signal S1*a* via an inverter 8.

Figure 16:
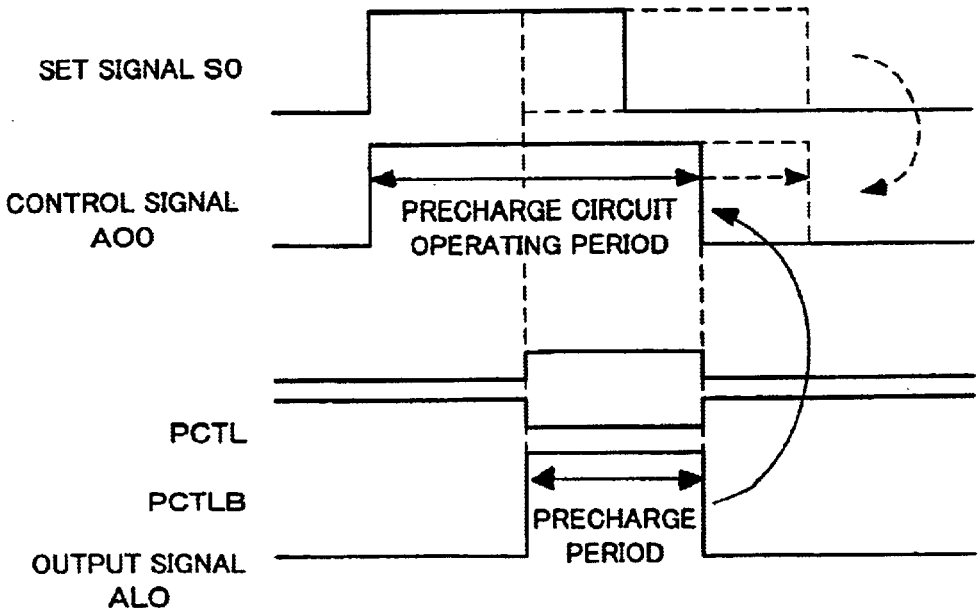
FIG. 16 is a drawing showing, as an example, timings of operations of the precharge control circuit of FIG. 15.

FIG. 16 shows timings of operations of the precharge control circuit 1 of FIG. 15. The set signal S0 becomes active before the precharge control signal PCTL becomes active and remains active at least until the precharge control signal PCTL becomes active. Upon this set signal S0 changing from L to H, the latch circuit 4*a* is activated and changes its output signal, i.e., the control signal AO0, from L to H. This causes the level shifter circuit 5 whose activation/ deactivation is controlled through the control signal AO0 to change into and remain in an active state and to output an output signal AL0 obtained by boosting the voltage of the externally provided, low-amplitude precharge control signal PCTL or precharge control signal PCTLB to substantially the same amplitude as that of the drive voltage for the precharge circuit 3.

The output signal AL0 is inverted by the inverter 8 and supplied as a reset signal S1*a* to the latch circuit 4*a*. This causes the latch circuit 4*a* to change to non-active upon the output signal AL0 changing from H to L and the output signal AL0 of the level shifter circuit 5 to remain at L, if the set signal S0 has changed from H to L as shown in the solid line in FIG. 16 after the precharge control signals PCTL and PCTLB change from active to non-active. In contrast, if the set signal S0 has changed from H to L as shown in the broken line in FIG. 16 before the precharge control signals PCTL and PCTLB change from active to non-active, the latch circuit 4*a* changes to non-active in response to the set signal S0 changing from H to L.

This arrangement eliminates the need to externally supply the reset signal S1 of the arrangement of FIG. 9. Only three input signals are needed to be supplied to the precharge control circuit 1: namely, the set signal S0 with the same amplitude as that of the power supply VDD and the precharge control signals PCTL and PCTLB supplied externally to the panel with low amplitudes. Therefore, the number of wires are reduced, and the circuit layout is made simple.

Figure 17:
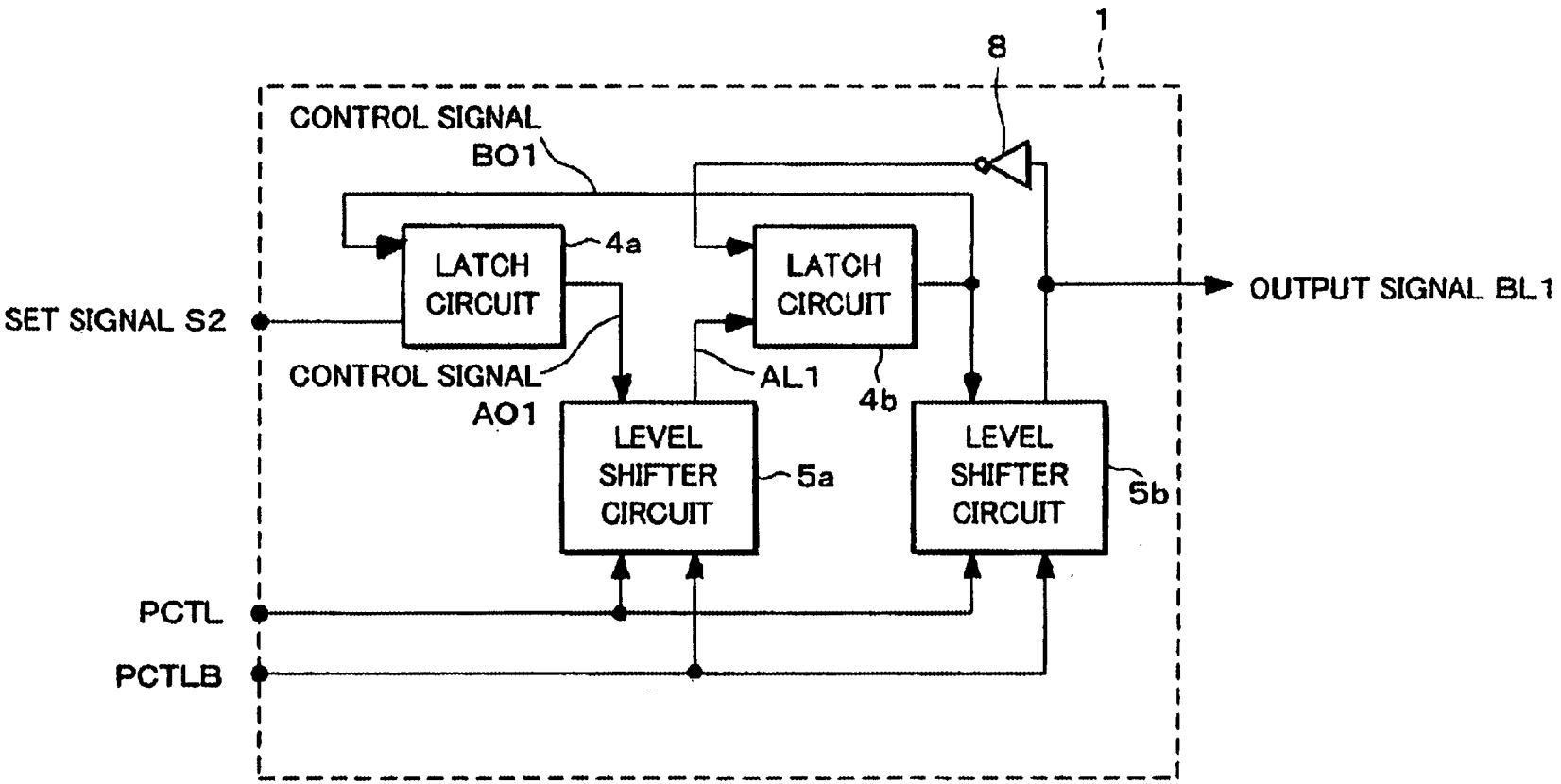
FIG. 17 is a block diagram showing, as another modified example, another arrangement of the precharge control circuit of FIG. 2 when the latch circuit of FIG. 11 is used.

FIG. 17 is a block diagram showing, as an example, another arrangement of the precharge control circuit 1 incorporated in the precharge circuit 3. The example here includes: a latch circuit 4*a* constituted by a set-overwrite-reset type flip-flop and an identical latch circuit 4*b* in place of the latch circuit 4 discussed in the foregoing; and level shifter circuits 5*a* and 5*b* of a current drive type.

Figure 18:
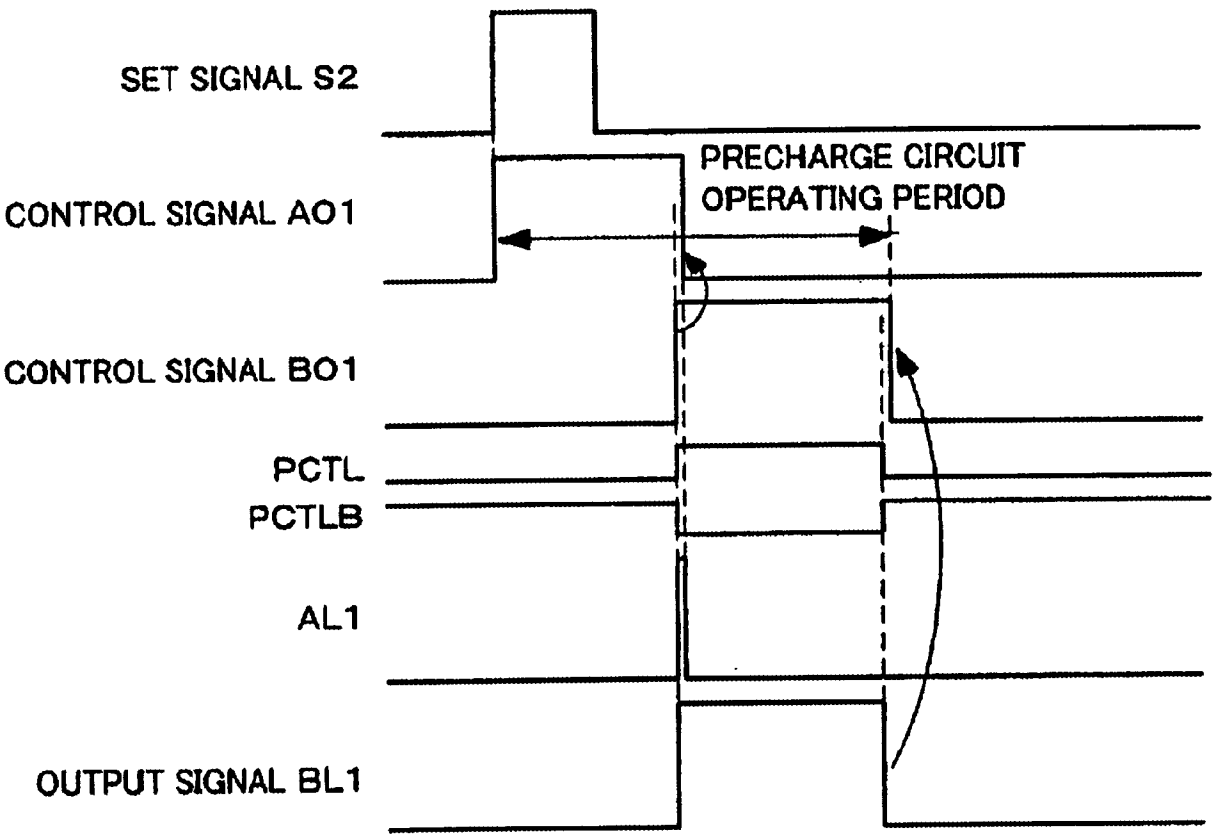
FIG. 18 is a drawing showing, as an example, timings of operations of the precharge control circuit of FIG. 17.

FIG. 18 shows timings of operations of the precharge control circuit 1 of FIG. 17. Upon the set signal S2 changing from L to H, the latch circuit 4*a* is activated and changes its output signal, i.e., the control signal AO1, from L to H. This causes the level shifter circuit 5*a* whose activation/deactivation is controlled through AO1 to change into and remain in an active state and to output, to the latch circuit 4*b*, a control signal AL1 obtained by boosting the voltage of the externally provided, low-amplitude precharge control signal PCTL or precharge control signal PCTLB to substantially the same amplitude as that of the drive voltage for the precharge circuit 3.

Upon the control signal AL1 changing from L to H, the latch circuit 4*b* in the second stage, which employs the control signal AL1 as its set signal, changes from a non-active state to an active state and changes its output, i.e., the control signal BO1, to the second stage level shifter circuit 5*b* from L to H. Here, the first state latch circuit 4*a* employs the control signal BO1 as its reset signal; therefore, if the set signal S2 has now already changed from H to L, the latch circuit 4*a* changes from an active state to a non-active state upon the control signal BO1 changing from L to H; in contrast, if the set signal S2 remains at H, the latch circuit 4*a* changes from an active state to a non-active upon the set signal S2 changing from H to L and changes its output signal, i.e., the control signal AO1, from H to L.

In this manner, the level shifter circuit 5*a* changes to a non-active state and the control signal AL1 changes from H to L. In addition, upon the control signal BO1 going H, the second stage level shifter circuit 5*b* changes to an active state and outputs an output BL1 obtained by boosting the voltage of the externally provided, low-amplitude precharge control signal PCTL or precharge control signal PCTLB to substantially the same amplitude as that of the drive voltage for the precharge circuit 3.

The output signal BL1 is inverted by the inverter 8, serving as a reset signal of the latch circuit 4*b*. Even when the level shifter circuit 5*a* changes into a non-active state and the control signal AL1 changes from H to L, the level shifter circuit 5*b* remains in an active state and continues to output a high control signal BO1, because the reverse signal of the output BL1 which is the reset signal is L. Thereafter, when the output BL1 changes from H to L upon a change of the precharge control signals PCTL and PCTLB, the reset signal of the latch circuit 4*b* becomes active, the latch circuit 4*b* changes into a non-active state, and the control signal BO1 changes from H to L. As a result of BO1 changing into L, the level shifter circuit 5*b* changes into a non-active state too. In this series of operations, constant current occurs only during the precharge circuit operating period of FIG. 18, which ensures reductions in current consumption like the comparative example shown in FIG. 4 in which the precharge circuit operates throughout the time.

This arrangement also requires only three input signals to the precharge control circuit 1 as the arrangement of FIG. 15: namely, the set signal S2 and the precharge control signals PCTL and PCTLB. Therefore, the number of wires are reduced.

Figure 19:
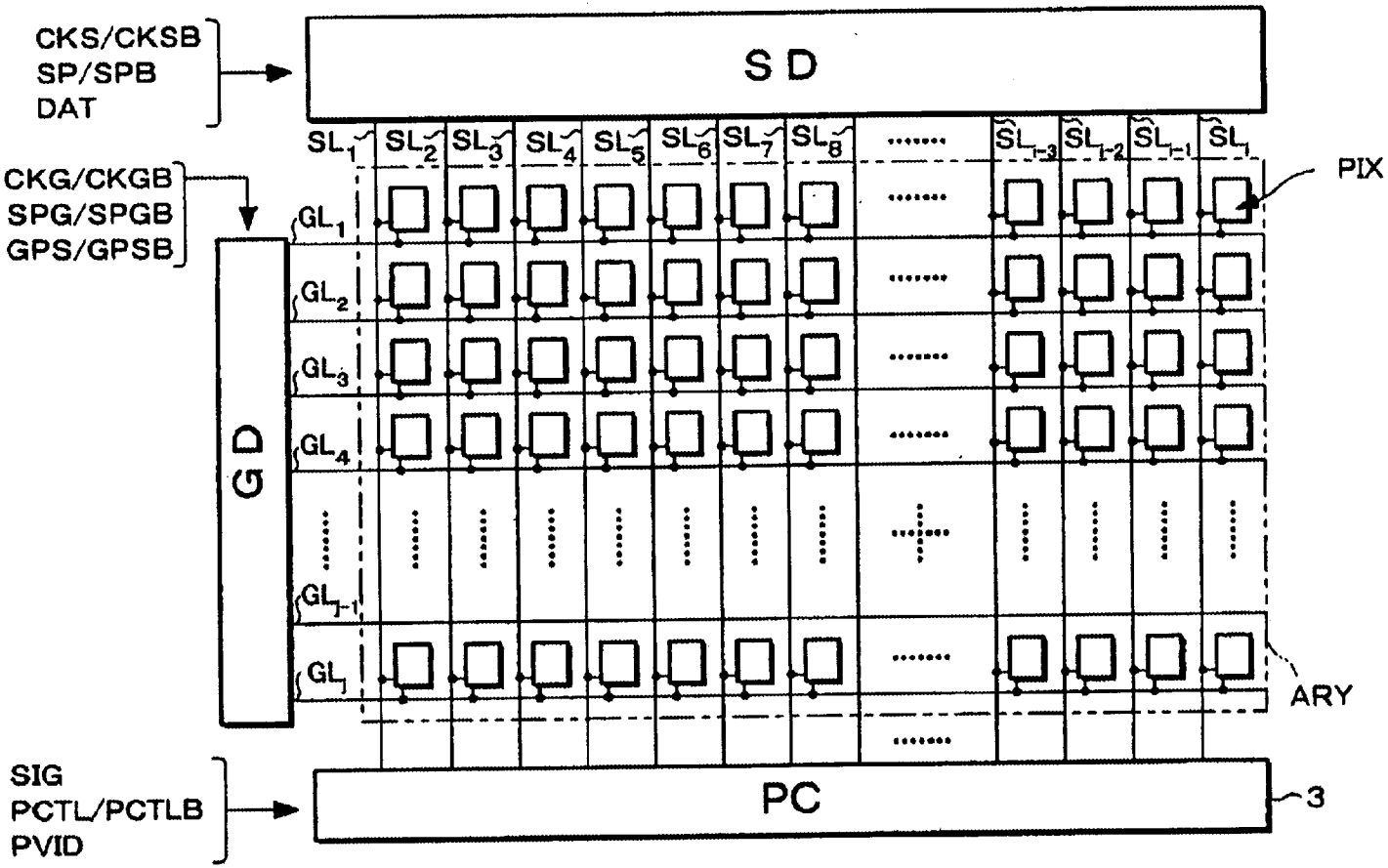
FIG. 19 is a block diagram showing, as an example, an arrangement of an image display device in accordance with the present invention.
Figure 20:
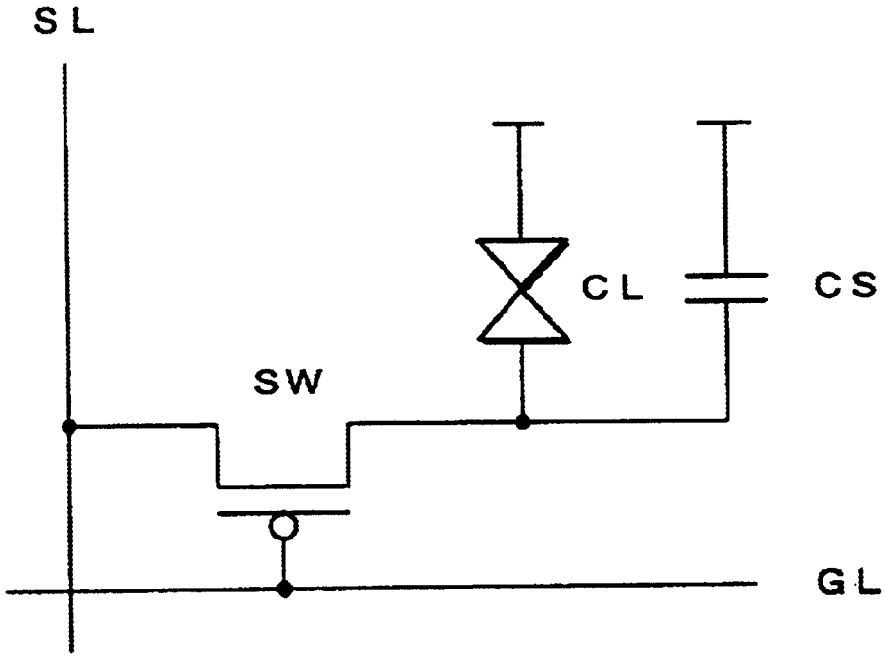
FIG. 20 is a drawing showing, as an example, an internal structure of a pixel in the image display device of FIG. 19.

FIG. 19 is a drawing showing, as an example, an arrangement of an image display device in accordance with the present invention. The arrangement of FIG. 19 is that of a liquid crystal display device of an active matrix type constituted, similarly to a conventional one, by a pixel array ARY, a scan signal line drive circuit (gate driver) GD, a data signal line drive circuit (data driver) SD, and a precharge circuit 3. The pixel array ARY includes pixels PIX arranged in a matrix (FIG. 20 is a diagram of an equivalent circuit showing the internal structure). A difference from conventional precharge circuit PC can be found in the precharge circuit 3 which is arranged as mentioned in the foregoing.

Generally, in a liquid crystal display device, a relatively high drive voltage of 15V to 25V is necessary to drive a liquid crystal element, and therefore, the drive circuit is often also driven by a voltage of a similar value. In contrast, the signal fed to the image display device, which is generated by an IC, has a typical voltage value of 3.3V to 5V. Therefore, a need arises to interpose a voltage conversion circuit (level shifter circuit) of some kind between these. In the present invention, as mentioned previously, by causing the level shifter circuit 5 of a current drive type to operate only during chosen periods, power consumption is restrained and a satisfactory image display is effected.

Referring to FIG. 1, the sampling switch 2 is arranged from a CMOS switch including pairs of a P-type transistor Mp1 to Mpi and a N-type transistor Mn1 to Mni for each data signal line SL1 to SLi. The transistors Mp1 to Mpi and Mn1 to Mni are connected at their drains to data signal lines SL1 to SLi and receive at their sources a common precharge voltage. The N-type transistors Mn1 to Mni receive at their gates the above-discussed, common output signals AL0 and BL1 of the precharge control circuit 1 which are buffered by two-staged inverters 9*a* and 9*b*. The P-type transistors Mp1 to Mpi receive at their gates the common output signals AL0 and BL1 which are here buffered not only by the inverter 9*a* and 9*b* but also by another inverter 9*c*.

The precharge voltage is either a variable voltage or a constant voltage predetermined according to a video signal (data) input to the data signal line drive circuit SD. By arranging the sampling switch 2 from a CMOS as mentioned above, when the precharge voltage is close to the potential of VDD, which is the power supply for the high level of the precharge circuit 3, the precharge voltage is principally applied to the data signal lines SL1 to SLi via p-type transistors Mp1 to Mpi. When the precharge voltage is close to the potential of VSS, which is the power supply for the low level of the precharge circuit 3, the precharge voltage is principally applied to the data signal lines SL1 to SLi via n-type transistors Mn1 to Mni. This restrains the dependence of the driving capability of the sampling switch 2 on the precharge voltage to the smallest extent, enabling uniform precharge effects to be obtained.

Figure 21:
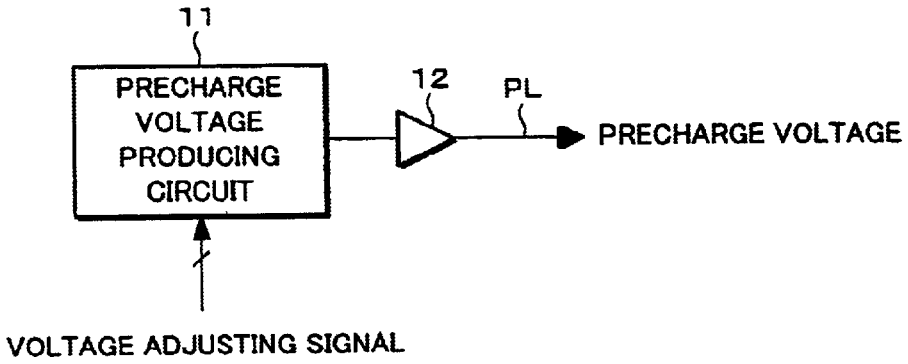
FIG. 21 is a drawing showing, as an example, a circuit for producing a precharge voltage.

The circuit for producing the precharge voltage includes a precharge voltage producing circuit 11 for producing a voltage in response to a single or plural voltage adjusting signal(s) as shown in FIG. 21, for example, and a buffer circuit 12 for buffing an output of the precharge voltage producing circuit 11 and outputting the buffered output to the output line PL of FIG. 1. The precharge voltage producing circuit 11 includes, as shown in 22, a trimmer resistor 15 between the power supply 13 for the high level and the power supply 14 for the low level. By a voltage selection circuit 16 adjusting the trimmer resistor 15 in response to the voltage adjusting signal, an intermediate voltage between the high and low levels produced by the trimmer resistor 15 is output as a precharge voltage. The arrangement of FIG. 22 causes any one or all of a horizontally synchronized signal HSYNC, a vertically synchronized signal VSYNC, the precharge control signal PCTL, and a correction signal to be input as voltage adjusting signals depending upon the precharge voltage mode.

As an example of an arrangement suitable in a case when the video signal is driven by alternating current, an explanation will be given on a case when the precharge voltage producing circuit 11 first outputs a potential of an opposite polarity to that of the immediately preceding video signal as the precharge voltage and then changes the output to a targeted precharge potential either at the start of the precharge period or a predetermined period after the start.

In an arrangement, for instance, such that the video signal is driven by an alternating current of a frequency equal to one horizontal period, and the output is changed to a precharge potential at the start of the precharge period, the precharge voltage producing circuit 11 receives inputs of the precharge control signal PCTL and the horizontally synchronized signal HSYNC as voltage adjusting signals. In this event, the voltage selection circuit 16 controls the trimmer resistor 15 based on the horizontally synchronized signal HSYNC so that a potential of an opposite polarity among the potentials predetermined for each polarity, when the precharge control signal PCTL is non-active. In contrast, the voltage selection circuit 16 controls the trimmer resistor 15 to output a predetermined precharge potential, when the precharge control signal PCTL is active.

If the precharge voltage is a constant voltage, the output voltage of the precharge voltage producing circuit 11 falls to the polarity of the immediately preceding horizontal or vertical period and converges to a predetermined precharge voltage. As a result, unless the precharge voltage producing circuit 11 has a sufficiently large driving capability, its output voltage may possibly not converge to a precharge voltage within a precharge period as shown in FIG. 23.

Figure 23:
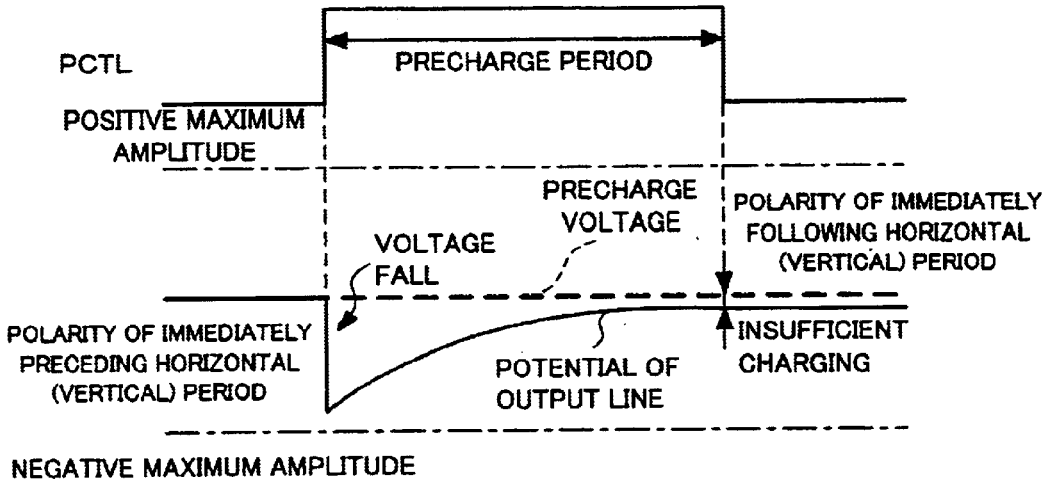
FIG. 23 is a waveform diagram showing a precharge voltage when a constant precharge voltage is produced.
Figure 24:
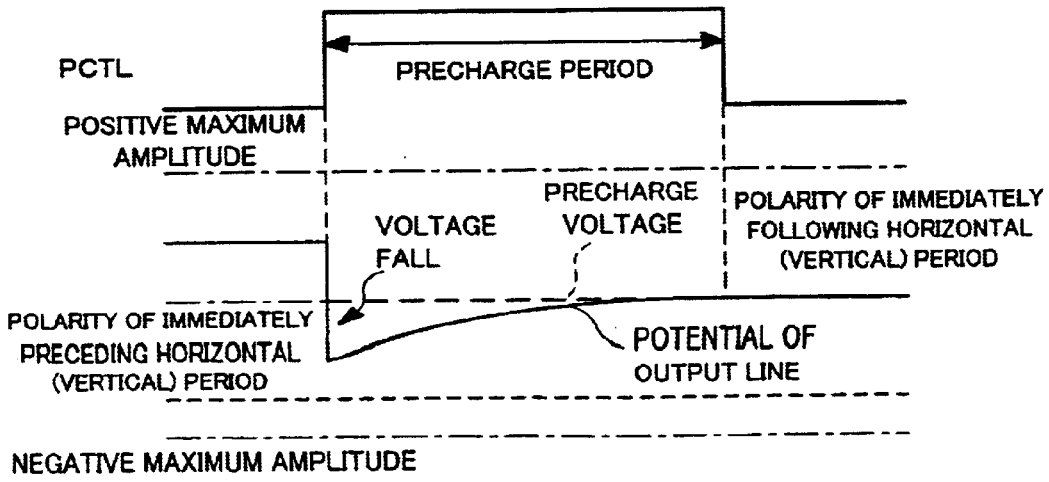
FIG. 24 is a waveform diagram showing a precharge voltage when the precharge voltage is produced based on a horizontally synchronized signal and a precharge control signal in the arrangement of FIG. 22.

In contrast, when the precharge voltage producing circuit 11 is outputting a potential of an opposite polarity to that of the immediately preceding video signal as previously mentioned, even if the drawing occurs to the same extent as shown in FIG. 24, the resultant potential closer to the targeted precharge voltage compared to the case of FIG. 23. The precharge voltage producing circuit 11 changes its output voltage to the targeted precharge voltage before the precharge period ends. These ensure that unlike the case of FIG. 23, the precharge voltage producing circuit 11, even with an insufficient driving capability, can charge up to the precharge voltage.

The foregoing explanation focused on the drive by means of an alternating current of a frequency equal to one horizontal period; however, if the horizontally synchronized signal HSYNC is replaced for a vertically synchronized signal VSYNC, the same explanation applies to the drive by means of an alternating current of a frequency equal to one vertical period. Either way, identical advantages result if the precharge voltage producing circuit 11 outputs a potential of an opposite polarity to that of the immediately preceding video signal based on the precharge control signal PCTL and the signal by which the polarity of the immediately preceding video signal can be judged.

Figure 25:
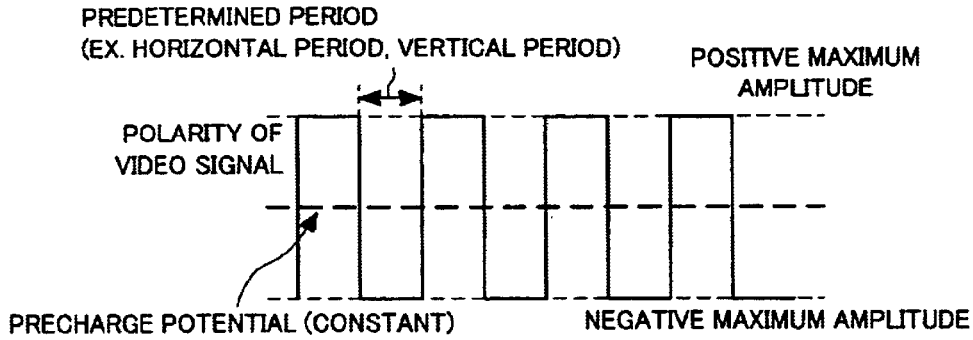
FIG. 25(*a*) to FIG. 25(*c*) are waveform diagrams showing a precharge voltage when the precharge voltage is produced based only on a correction signal in the arrangement of FIG. 22.
Figure 25:
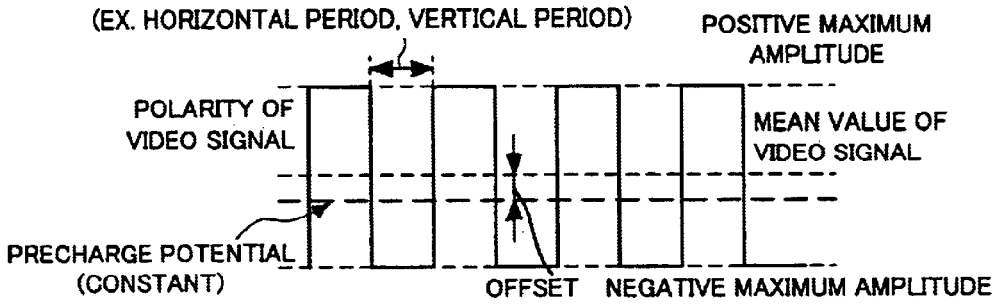
Figure 25:
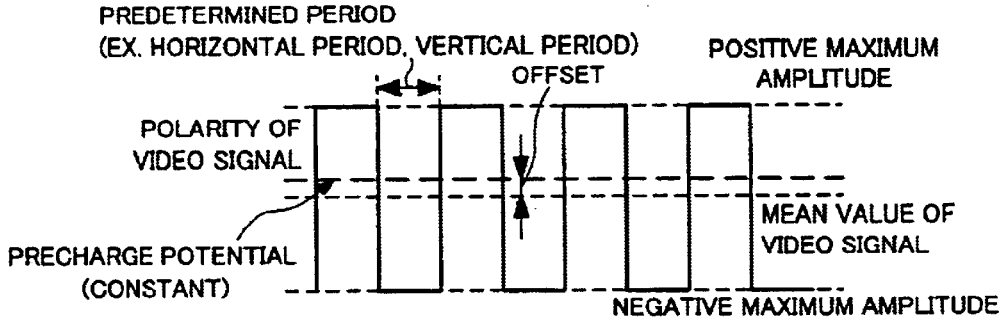
Figure 25:
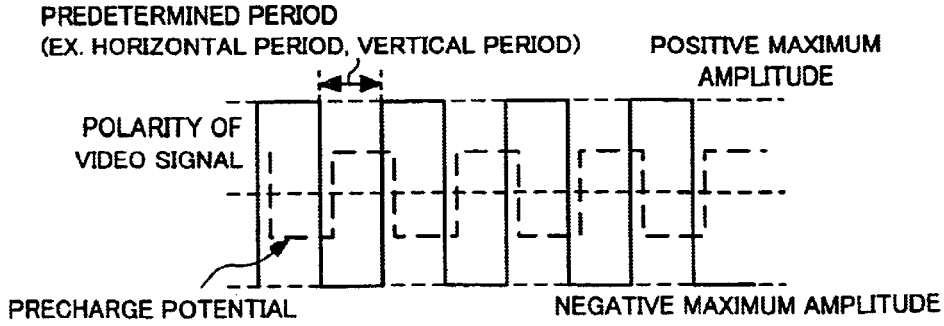

Now, an explanation is given in reference to FIGS. 25(*a*) to 25(*c*) on a case when a correction signal is supplied to the precharge voltage producing circuit 11 of FIG. 23 as a voltage adjusting signal. The correction signal compensates for those offsets of differences in properties of the p-type and N-type transistors on the panel and the precharge voltage obtained by measuring flickers in the display of real images.

Figure 26:
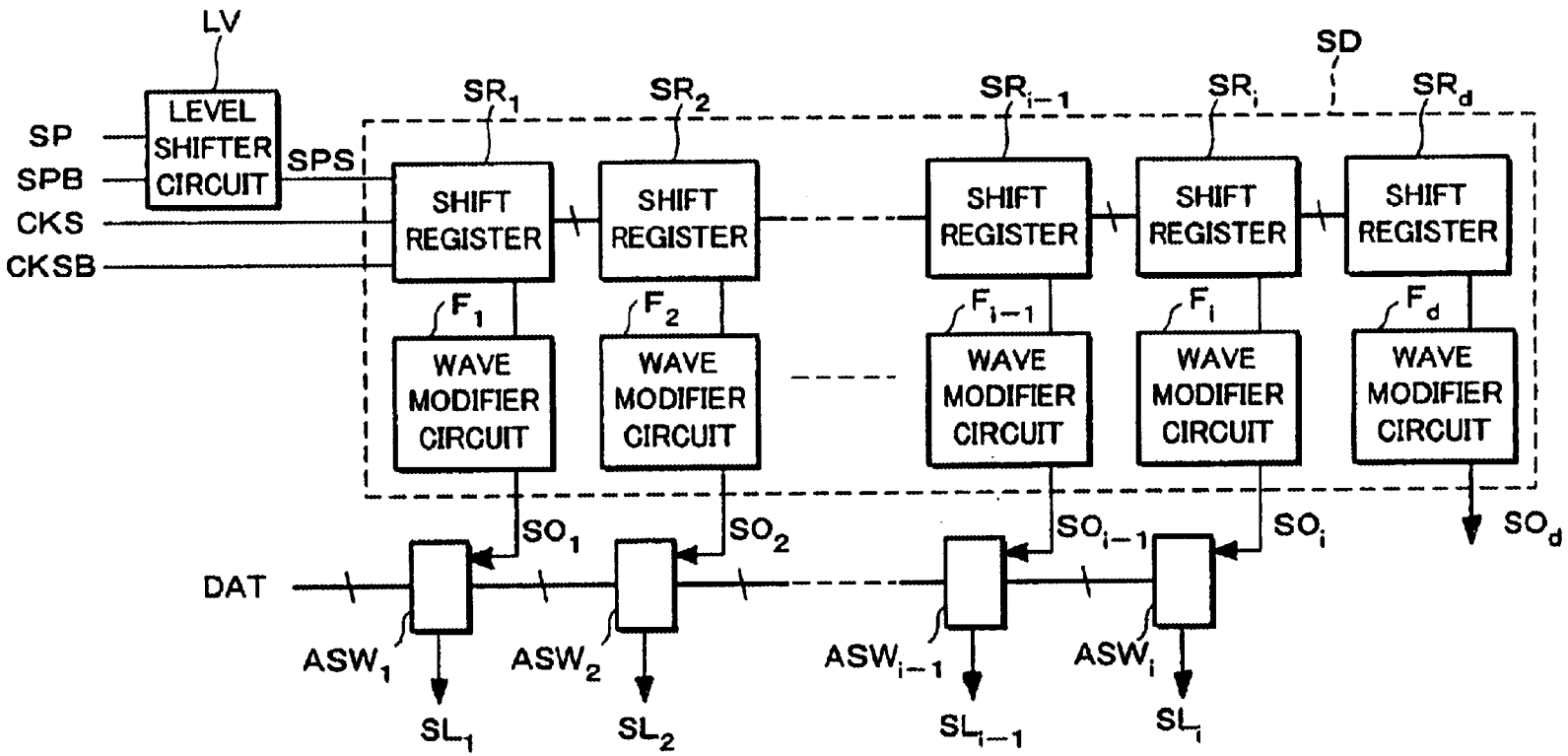
FIG. 26 is a block diagram showing, as an example, an arrangement of a data signal line drive circuit.

Each data signal line SL1 to SLi is provided individually with an analogue switch ASW1 to ASWi for sampling a video signal (data) DAT as shown in FIG. 26. These analogue switches ASW1 to ASWi cause the video signal (data) DAT to be sequentially sampled by and written to the data signal lines SL1 to SLi. The analogue switches ASW1 to ASWi are arranged from CMOS switches like the sampling switch 2 of FIG. 1 so that they can drive in both directions. However, the N-channel and P-channel transistors incorporated in each CMOS switch may differ from one another in driving capabilities due to differences in transistor properties, for example.

Here, supposing that the transistors are specified to exhibit sufficient driving capabilities so that those with smaller driving capabilities are still sufficiently powerful for the sample in spite of existence of such differences, the analogue switches ASW1 to ASWi can sample the video signal regardless of the charging polarity. However, if the driving capabilities are increased beyond the need, the transistors will account for an undesirably increased area and consume an undesirably large power. Meanwhile, if the driving capabilities are specified to low values, one of the transistors may be sufficiently powerful for the sample with the other transistor being not powerful enough for the sample.

In contrast, when the two transistors have an identical driving capability, the precharge voltage producing circuit 11, which refers to the correction signal, as shown in FIG. 25(*a*), outputs a mean value of the positive polarity maximum amplitude value and the negative polarity maximum amplitude value. Meanwhile, if the two transistors do not have an identical driving capability and irregular writing occurs depending on the charging direction, as shown in FIGS. 25(*b*) and 25(*c*), the precharge voltage producing circuit 11 changes the precharge potential from the mean value (in the case of FIG. 25(*a*)) to a value which offsets the irregular writing based on the correction signal. This enables both reduction in the driving capabilities and elimination of irregular writing to be achieved. Further, if the precharge potential is constant, there is less load on the external circuit driving the image display device, rendering the external simpler and less power-consuming.

The foregoing explanation focused on a case where the reference is set to a mean value, which is a suitable arrangement to a sampling switch 2 with a relatively high driving capability and a video signal (data) with an amplitude level which is sufficiently small as compared to the drive power supply voltage of the data signal line drive circuit SD. To further reduce the load on the circuit producing the precharge voltage or the power consumption, the precharge voltage may be set to a constant value that is used more frequently than others, not to the mean value.

Figure 22:
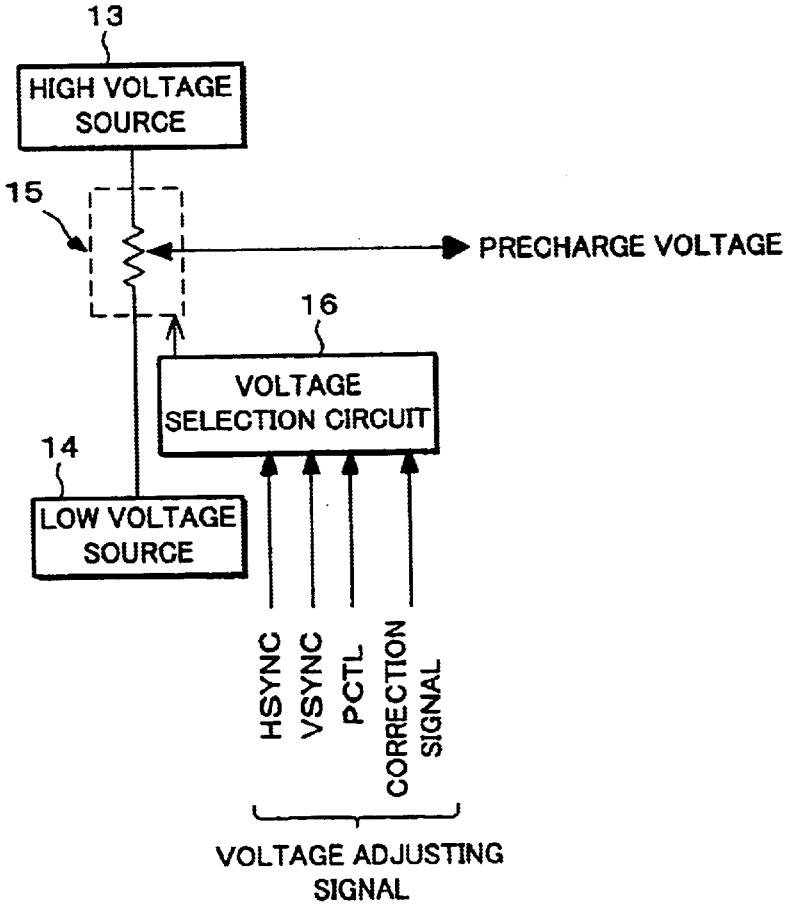
FIG. 22 is a block diagram showing in detail the precharge voltage producing circuit.

FIG. 22 shows, as a further example, an arrangement in which the precharge voltage producing circuit 11 supplies as the voltage adjusting signal either a horizontally synchronized signal HSYNC or a vertically synchronized signal VSYNC to change the precharge voltage in accordance with the polarity of a succeedingly written video signal as shown in FIG. 25(*d*). In this event, the difference is further reduced between the precharge potential to the potential of the written video signal. As a result, even if the sampling switch 2 has a small driving capability, the video signal be securely written and a capability is achieved to display images with good quality.

The foregoing explanation dealt with the adjusting methods separately for the sake of convenience. Alternatively, two or more adjusting methods can be used at the same time: for instance, all the adjusting methods can be used at the same time wherein the correction signal, the horizontally synchronized signal HSYNC or the vertically synchronized signal VSYNC, and the precharge control signal PCTL are supplied as voltage adjusting signals.

Figure 27:
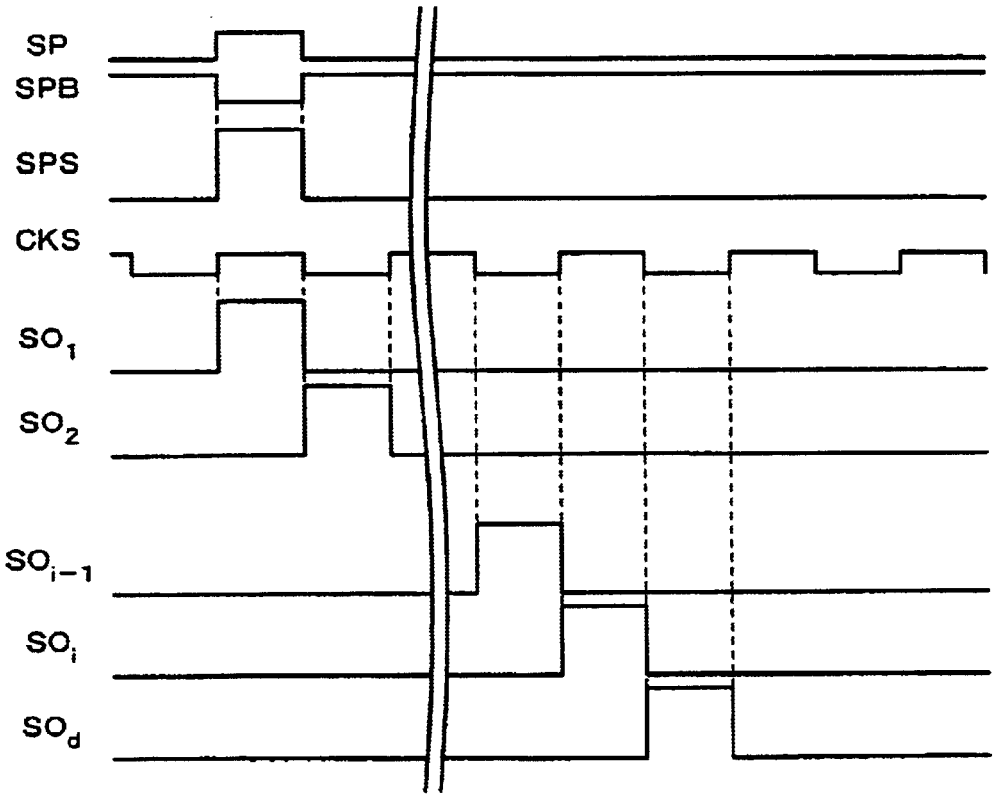
FIG. 27 is a waveform diagram showing operations of the data signal line drive circuit of FIG. 26.

FIG. 26 is a block diagram showing, as an example, an arrangement of the data signal line drive circuit SD, while FIG. 27 is an operation waveform. The data signal line drive circuit SD receives a start signal SPS and a low-amplitude clock signal CKS/CKSB which are supplied external to the panel, the start signal SPS being obtained by boosting the voltage of the low-amplitude start signal SP/SPB by the level shifter circuit LV to the level of the power supply VDD of the data signal line drive circuit SD. As the start signal SPS representative of the start of a horizontal scanning cycle is supplied to a first-stage shift register SR1, pulses are transmitted in response to clock signals CKS/CKSB down to the second-and later-stage shift registers SR2 to SRi and SRd coupled in this order in series. The pulses are modified in waveform in the individually provided waveform modifier circuit F1 to Fi and Fd and output as signal line selection signals SO1 to SOi and SOd.

Meanwhile, each data signal line SL1 to SLi is provided with an individual analogue switch ASW1 to ASWi for sampling a video signal (data) DAT. As a result of the analogue switches ASW1 to ASWi being driven by the signal line selection signals SO1 to SOi, the video signal (data) DAT is sequentially sampled by and written to the data signal lines SL1 to SLi. The signal line selection signal SOi travels over the panel and is supplied to the precharge circuit 3.

Figure 28:
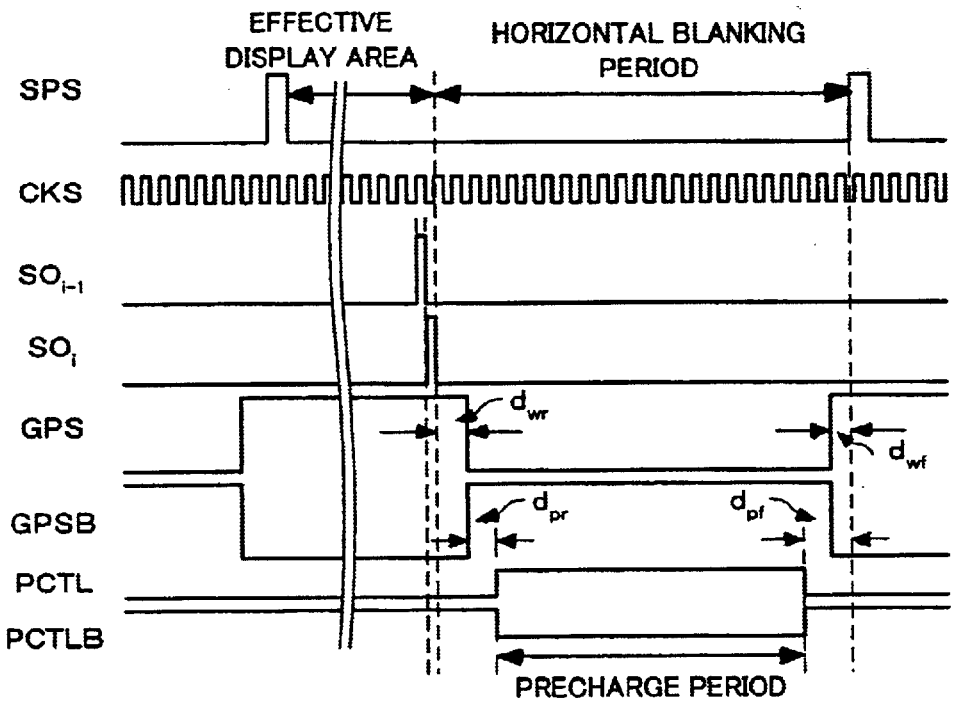
FIG. 28(*a*) is a drawing showing, as an example, an input signal timing chart for an image display device to which a precharge circuit in accordance with the present invention is mounted.
Figure 28:
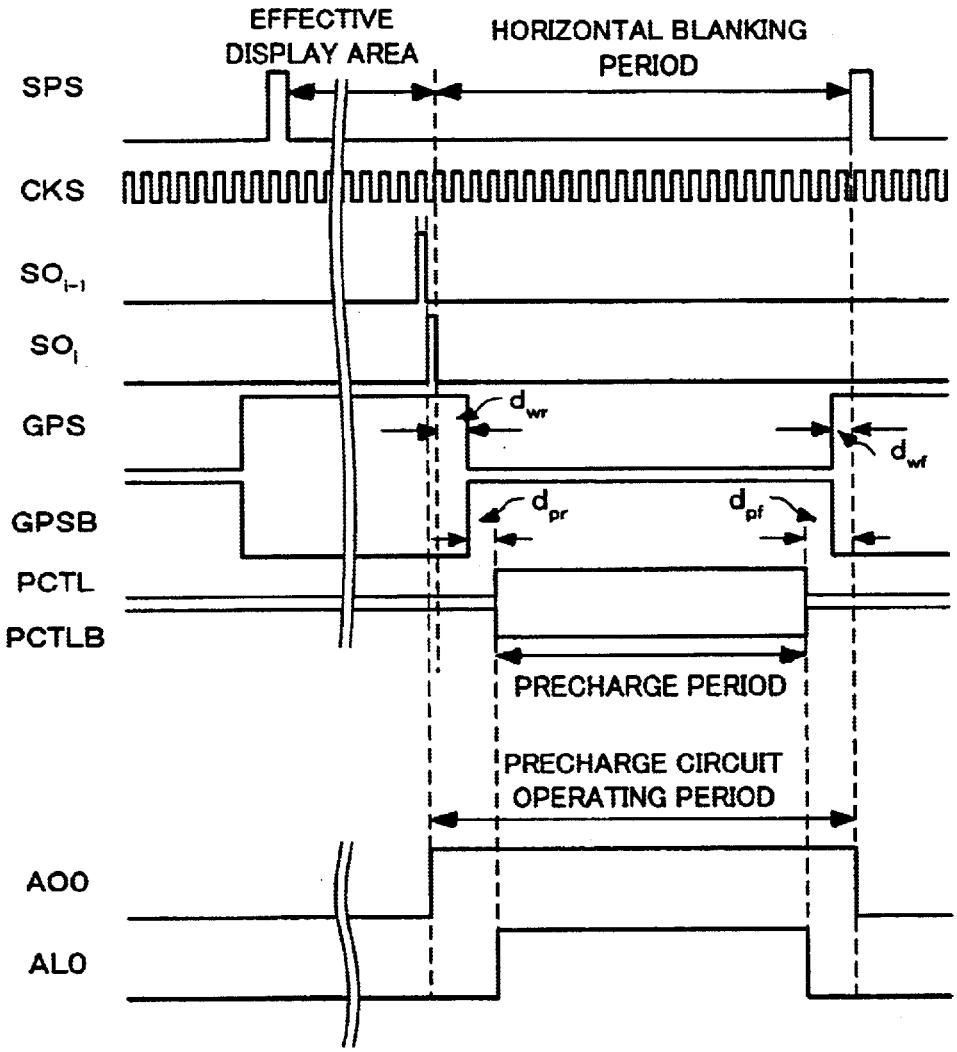
Figure 28:
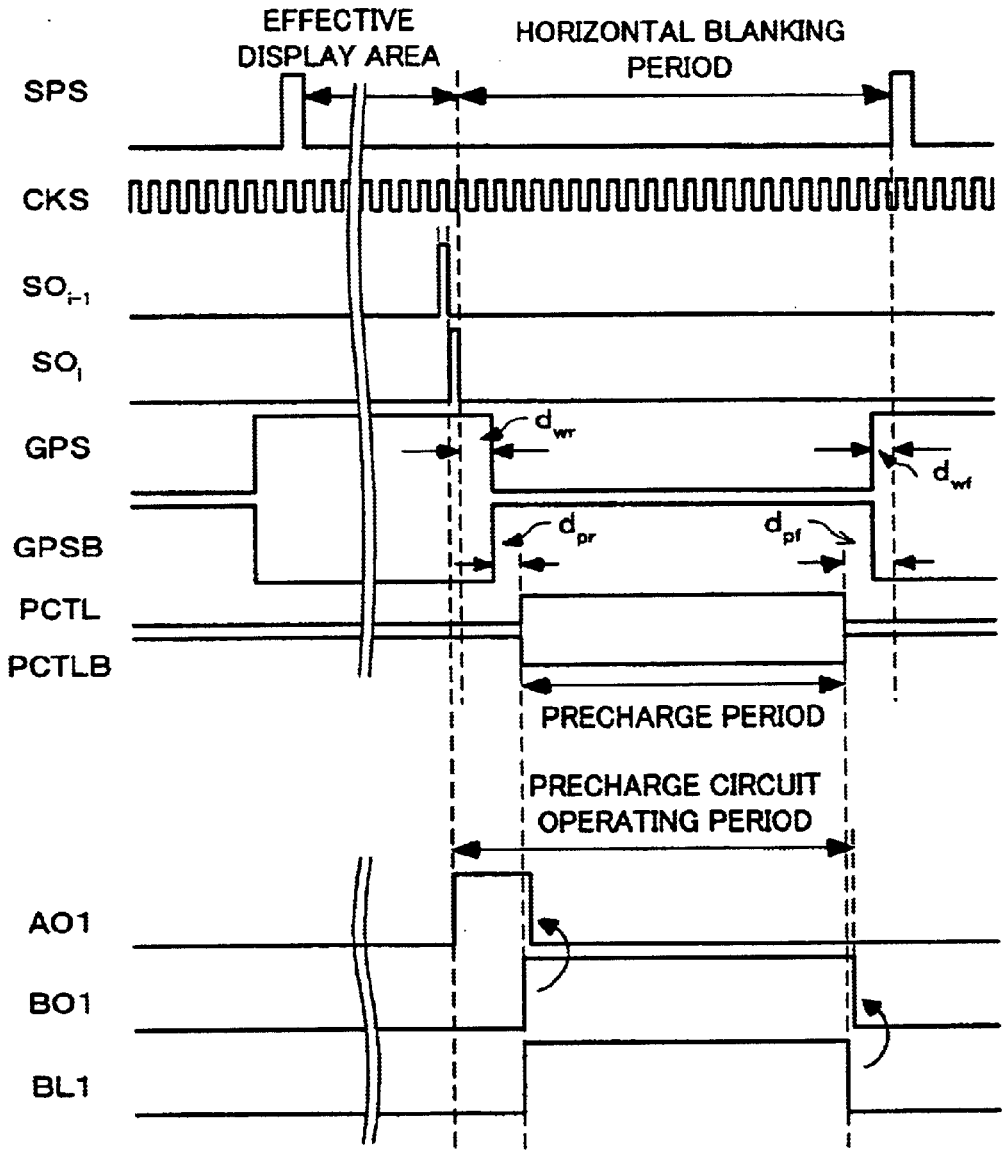

FIG. 28(*a*) shows a typical input signal timing chart of an image display device to which the precharge circuit 3 is mounted. In FIG. 28(*a*), SPS is a signal representative of a start of a horizontal scan cycle, CKS a low-amplitude clock signal fed to the data signal line drive circuit SD, and SOi-1 and SOi signal line selection signals. GPS and GPSB represent chosen periods, that is, effective display areas, for the scan signal line GL produced by the scan signal line drive circuit GD. PCTL and PCTLB are precharge signals as previously explained, and in FIG. 28(*a*), the precharge period is provided in a horizontal blanking period. According to the present invention, the precharge circuit 3 operates, i.e., the aforementioned level shifter circuit 5, 5*a*, or 5*b* operates, only during a predetermined, shorter period, encompassing this period, than an effective display period in a horizontal period.

FIG. 28(*b*) is a timing chart of operations of the precharge circuit 3 incorporating the precharge control circuit 1 that is arranged as in FIG. 9 and that employs the last signal line selection signal SOi as its set signal S0 and the start signal SPS as its reset signal S1. Therefore, the precharge circuit 3 can be caused to operate from the time immediately before the horizontal blanking period until the first signal line selection signal SO1 is output. In other words, the precharge circuit 3 does not operate almost throughout an effective display period. In this event, the precharge circuit 3 actually operates and thus consumes power only during a horizontal blanking period plus a signal clock period of the clock signal CKS during which the last signal line selection signal SOi is output. For example, for NTSC mode, the horizontal blanking period is 13 μs for an effective display area of about 50 μs, and a single clock period is about a few hundred nsec long. The power consumption in the precharge circuit 3 can be reduced to about a quarter (more precisely, 13/50) that of the precharge circuit which operates throughout the time.

Japanese Laid-Open Patent Application No. 7-121139/1995 (Tokukaihei 7-121139; published on May 12, 1995) teaches reduction in power consumption by means of precharging only during effective display periods. However, the effective display period is immediately preceded and succeeded by a vertical blanking period, and the precharge circuit does not operating almost throughout a vertical blanking period. During a vertical blanking period, in NTSC mode, a vertical cycle is 16.7 msec, whereas a vertical blanking period is 2.85 msec and accounts for 17%. In contrast, the non-operating period of the present invention is, as mentioned above, about three quarters, which contributes greatly to reduction in power consumption. However, the arrangement as disclosed in Tokukaihei 7-121139 may, of course, be used in combination.

Besides, in Tokukaihei 7-121139, the precharge voltage is being permanently produced, but is prevented from being output by causing the output circuit to have a high impedance. In the present invention, the constant current in the precharge circuit 3 (the current supplied by the constant current source 7) is stopped by the control of the level shifter of a current drive type, and therefore less power is consumed.

FIG. 28(*c*) is a timing chart of operations of a precharge circuit in a case where SOi is used as the set signal S2 for the precharge control circuit 1 arranged as in FIG. 17. In this case, the precharge circuit 3 operates during the precharge period and operation margins $d_{wr}$ and $d_{pr}$. Power consumption can be further restrained by $d_{wf}+d_{pf}$ which is about equal to the sum of the operation margins as compared with the previous case. Further, no control signal is needed other than S2; therefore, as mentioned earlier, the wiring becomes easy to design and affects the panel size to the least extent possible.

Further, in such an arrangement that a signal line selection signal SOd that does not correspond to any of the signal lines is output following to the last signal line selection signal SOi as in the data signal line drive circuit SD of FIG. 26, if the signal line selection signal SOd is used as the foregoing set signals SO and S2, the precharge circuit 3 can be caused to operate simultaneously as the driving of the last signal line SLi completes, the operating period of the precharge circuit 3 can be shortened by a signal clock period of the foregoing signal line selection signal SOi, the wiring does not place any extraneous load on the waveform modifier circuit Fi of the last signal line SLi, and display irregularity due to this can be eliminated too.

In the present invention, not only the signal line selection signal SOi of the last signal line SLi and its subsequent signal line selection signal SOd, but also other signals, such as SOi-1 and SOi-2, may be used as the set signals S0 and S2. In addition, not only the start signal SPS, but also other signals, such as SO1 and SO2, may be used as the reset signal S1. The precharge circuit 3 only needs to operate during a shorter period, encompassing the precharge period, than an effective display period in a horizontal period.

Besides, in the image display device of FIG. 19, the drive circuit can be manufactured and packaged at reduced costs and with improved reliability if the data signal line drive circuit SD, the scan signal line drive circuit GD, and the precharge circuit 3 are provided on the same substrate as pixels (monolithic structure), as compared when these circuits are provided on a separate substrate from the pixels.

Figure 29:
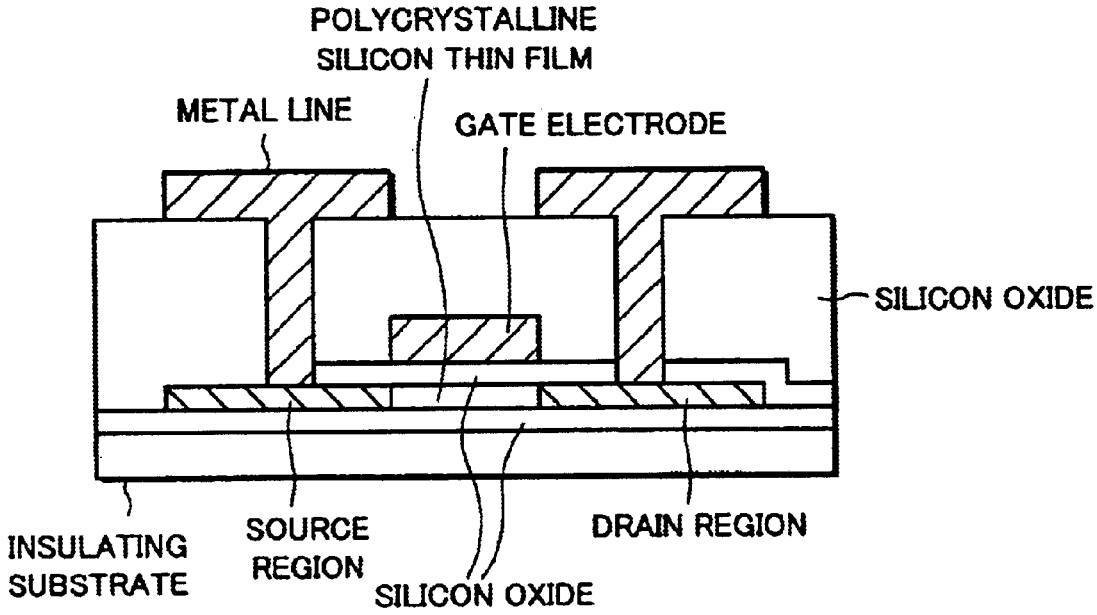
FIG. 29 is a drawing showing, as an example, a cross-section structure of a polycrystalline silicon thin film transistor incorporated in an image display device in accordance with the present invention.

FIG. 29 is a drawing showing, as an example, a structure of a polycrystalline silicon thin film transistor in the image display device. The polycrystalline silicon thin film transistor shown in FIG. 29 has a stagger (top gate) structure wherein the polycrystalline silicon thin film on the insulating substrate (insulation substrate) acts as an active layer. The present invention is not limited to this; the polycrystalline silicon thin film transistor may have a different structure such as an inverted stagger structure.

The provision of such polycrystalline silicon thin film transistors enables the scan signal line drive circuit GD, the data signal line drive circuit SD, and the precharge circuit 3 to be fabricated on the same substrate as the pixel array by substantially the same manufacturing steps as original, but with driving capabilities for practical purposes. Further, the polycrystalline silicon thin film transistor has a driving capability smaller by one or two orders of magnitude and exhibits less uniform characteristics than the monocrystalline silicon thin film transistor (MOS transistor) and therefore is required to have a wide operation margin as a drive circuit.

Accordingly, as the level shifter circuit incorporated in a low voltage interface of the image display device, a current drive type is typically used, since it ensures wider operation margins for transistor characteristics than a voltage drive type. Constant current exists in a level shifter circuit of a current drive type, which will increase power consumption by the image display device. However, by employing the precharge circuit 3 in accordance with the present invention, the level shifter circuit, 5, 5*a*, or 5*b*, of a current drive type in the precharge circuit can be caused to operate only during chosen periods, and power consumption can be restrained in the precharge circuit 3 with a low voltage interface.

Figure 30:
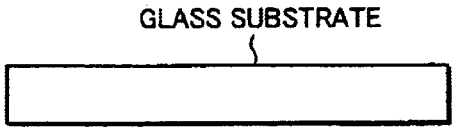
FIG. 30(*a*) to FIG. 30(*k*) are drawings showing, as an example, manufacturing steps of the polycrystalline silicon thin film transistor of FIG. 29.
Figure 30:
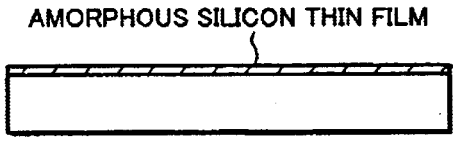
Figure 30:
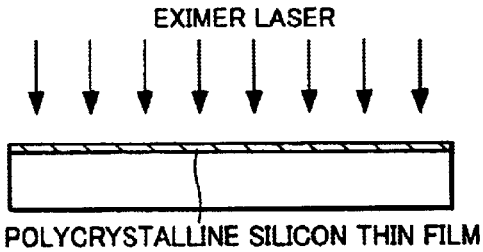
Figure 30:
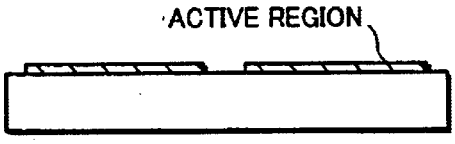
Figure 30:
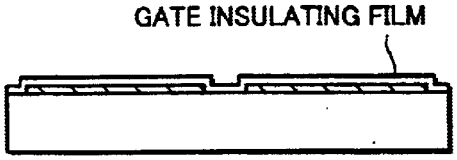
Figure 30:
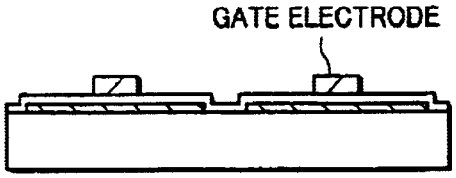
Figure 30:
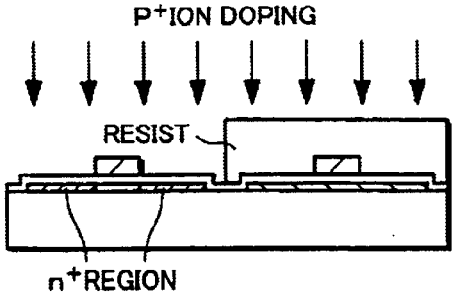
Figure 30:
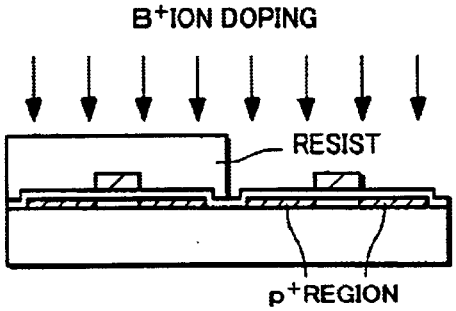
Figure 30:
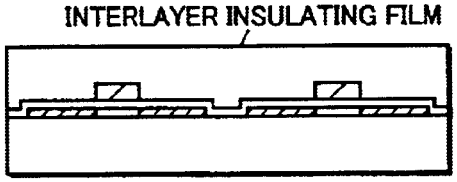
Figure 30:
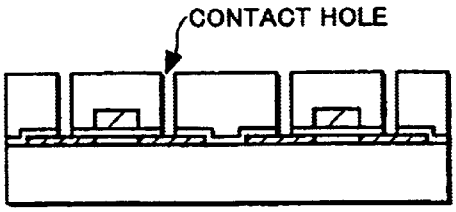
Figure 30:
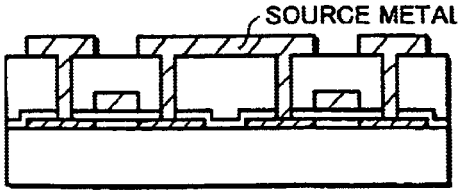
Figure 31:
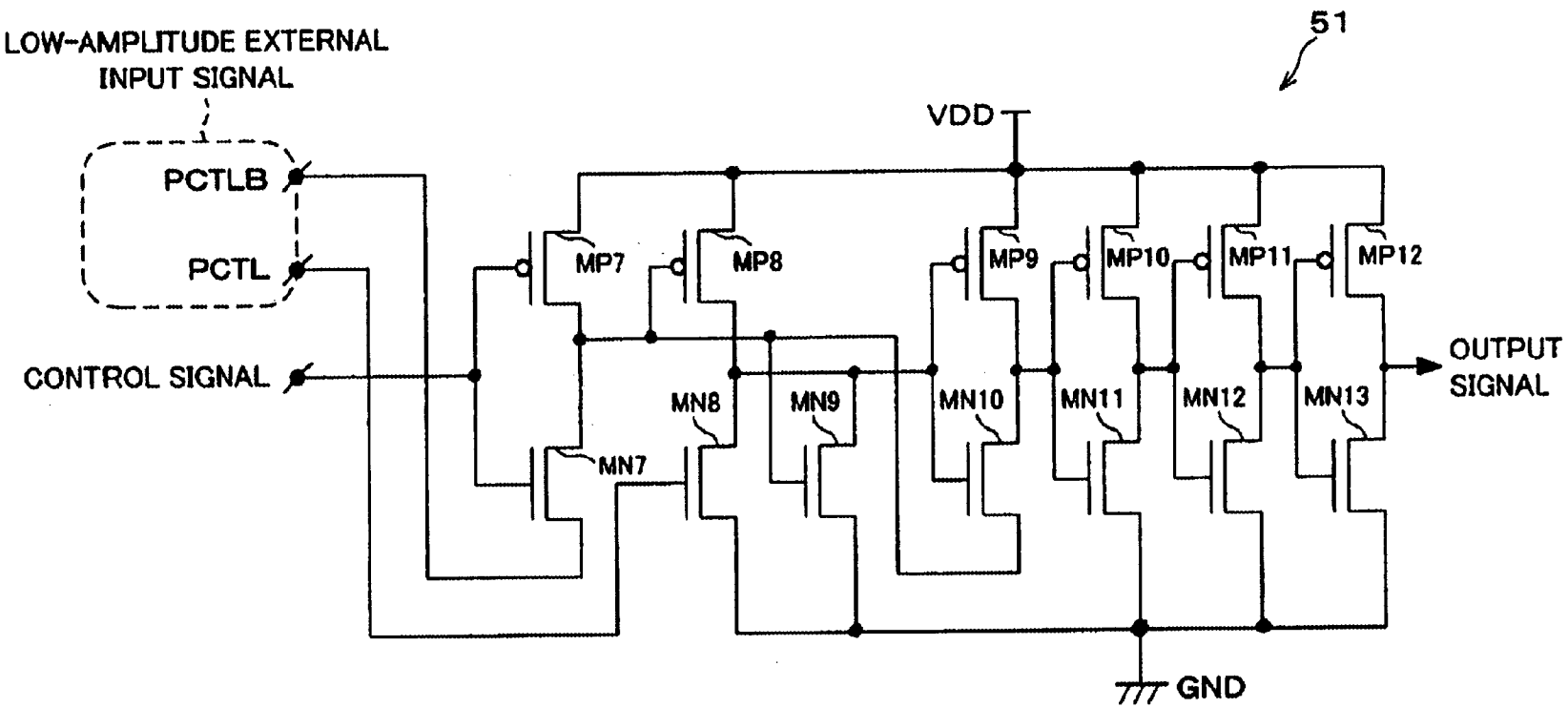
FIG. 31 is a block diagram showing, as an example, another arrangement of a level shifter circuit.

FIGS. 30(*a*) to 30(*k*) are explanatory drawings showing, as an example, manufacturing steps of a polycrystalline silicon thin film transistor incorporated in the image display device in accordance with the present invention.

The following is a brief explanation of a manufacturing process for a polycrystalline silicon thin film transistor at or below 600° C. in reference to FIGS. 30(*a*) to 30(*k*). FIGS. 30(*a*) to 30(*k*) represent steps in the process.

A glass substrate is prepared first (see FIG. 30(*a*)). Then, an amorphous silicon thin film is deposited on the glass substrate (see FIG. 30(*b*)). Excimer laser is shone to form a polycrystalline silicon thin film (see FIG. 30(*c*)). The polycrystalline silicon thin film is patterned as desired (see FIG. 30(*d*)), and a gate insulating film is formed of silicon dioxide (see FIG. 30(*e*)). Subsequently, gate electrodes are formed of aluminium or another metal for the thin film transistor (see FIG. 30(*f*)). Thereafter, the source and drain regions in the thin film transistor are impregnated with impurities (phosphorus for the n region and boron for the p region) (see FIGS. 30(*g*) and 30(*h*)). Then, an interlayer insulating film made of silicon dioxide, silicon nitride, or the like is deposited (see FIG. 30(*i*)), through which a contact hole is provided (see FIG. 30(*j*)). Finally, aluminium and other metal wiring is formed (see FIG. 30(*k*)). Throughout these steps, temperature does not exceed 600° C. which is reached during the formation of the gate insulating film. Therefore, a highly heat-resistant glass, such as 1737 glass available from Corning Inc. in the USA, can be used.

To complete the fabrication of a liquid crystal display device, electrodes (transparent ones for a transparent liquid crystal display device and reflective ones for a reflection type liquid crystal display device) are further provided via another interlayer insulating film. Here, the fabrication of a polycrystalline silicon thin film transistor at or below 600° C. by the manufacturing steps of FIG. 30(*a*) to FIG. 30(*k*) allows the use of an inexpensive, large area glass substrate, which in turn offers a wider range of selections for substrate material and enables reductions in the price and increases in the area of the image display device.

So far, the description has focused on the use of the circuit of FIG. 3 as the level shifter circuit of a current drive type; however, there are alternative. For instance, a level shifter circuit 51 of FIG. 31 may be used. The level shifter circuit 51 is basically of a source follower type and is fed with an output signal, whose amplitude is almost identical to that of the drive voltage VDD of the level shifter circuit 51, in phase with a precharge control signal PCTL supplied to the gate of MN8 and a precharge control signal PCTLB supplied to the gate of MP8 and the source of MN10.

Here, the level shifter circuit 51 includes MN7, as a switch for controlling operation of the circuit, located between a signal input terminal and the gate of MP8 (i.e., the source of MN10) that is one of input sections. To remain in a stable state during non-active periods, the level shifter circuit 51 further includes MP7 located between the gate of MP8 that floats in a non-active state, the node of the source of MN10, and the power supply VDD, as well as MN9 as a potential clamping switch located between GND and the node connecting the drains of MN8 and MP8 to the gates of MN10 and MP9.

The switches MN7 and MP7 receive a control signal at their gates. If the control signal is high level (active), the potential clamping switch MP7 turns off, while the switch MN7 for controlling the operation of the circuit turns on. This enables the level shifter circuit 51 to operate.

In contrast, if the control signal is low (non-active), the potential clamping switch MP7 turns on, MN9 turns on accordingly, and the switch MN7 for controlling the operation of the circuit turns off. This causes MP8, MN7, and MN10 to completely obstruct the path from the power supply VDD via MP8 and MN8 to GND through which a constant current flows in an active state and to completely obstruct the path from the power supply VDD via MP9, MN10, and MN7 to an external signal input terminal through which a constant current flows in an active state; therefore, no current passes in a non-active state.

Further, the potential clamping switch MP7 clamps the output from the level shifter circuit 51 to a low in a non-active state for the following reasons. When the control signal is low, the potential clamping switch MP7 turns on, and MN9 turns on accordingly. Upon the turning on of MN9, MP9 turns on, which turns on MN11. Upon the turning on of MN11, MP11 turns on, which turns on MN13. As a result, the output from the level shifter circuit 51 is clamped to a low. MP7 to MP12 are all P-type MOSFETs, and MN7 to MN13 are all N-type MOSFETs.

The arrangement discussed above enables the level shifter to operate only during chosen periods and thereby ensures reductions in power consumption in the precharge circuit 3.

It is, however, preferable to employ the arrangement of FIG. 3 for ordinary use, because the level shift circuit 5 of FIG. 3 provides a large operating margin for irregularities in transistor properties and level shift level as compared with the level shifter circuit 51.

The present invention has been so far discussed by way of several embodiments, but is not limited to these examples. The present invention is similarly applicable to any combination of the above embodiments and further arrangements including kinds and polarities of the signals used.

As detailed so far, a precharge circuit (3) in accordance with the present invention is for precharging a signal line (SL) to a predetermined voltage before applying a video signal to the signal line and is characterized by the following arrangement.

The precharge circuit is characterised in that it includes a precharge control circuit (1) which operates during a shorter period, encompassing a precharge period not coinciding with a drive period of the signal line, than an effective display period in a horizontal period and which effects such control to output the predetermined voltage.

According to the arrangement, after the signal line is precharged to a predetermined voltage, a video signal is applied to the signal line.

Conventionally, the precharge circuit operates throughout the time. A constant current flows in the precharge circuit even during non-precharge periods as long as the precharge circuit is operating, which results in an increase of power consumption in the precharge circuit.

Accordingly, in the present invention, a precharge control circuit is provided which operates during a specific, shorter period, encompassing a precharge period not coinciding with a drive period of the signal line, than an effective display period in a horizontal period; therefore, the precharge voltage is output only during active periods of the precharge circuit. Due to this control, the constant current no longer flows in the precharge circuit during non-active periods. Power consumption is limited only to active periods, which restrains increases in power consumption in the precharge circuit with corresponding certainty.

Here, the horizontal blanking period, although being predetermined in NTSC or other television mode, is in some situations specified relatively long in personal computer and other image display mode so as to be able to adapt to stylus input and other additional functions of the panel. If the horizontal blanking period becomes extremely long, the effective display period may be shorter. The present invention is suitably used in such situations because the operating period of the precharge circuit is further cut down.

Preferably, the precharge control circuit controls the precharging based on an externally supplied, low-amplitude external input signal which has an amplitude lower than that of a drive voltage of the precharge circuit and which maintains the amplitude during the precharge period.

In this event, an external circuit only needs to supply to the precharge control circuit an external input signal with an amplitude lower than that of a drive voltage of the precharge circuit, thereby enabling the load and power consumption in the external circuit to be reduced. This ensures the provision of a low voltage interface.

As detailed so far, a precharge circuit in accordance with the present invention is for precharging a signal line to a potential of a constant level before applying a signal of a desired level to the signal line and is characterised by the following arrangement.

The precharge circuit is characterised in that it includes a precharge control circuit which operates only during a precharge period not coinciding with a drive period of the signal line and which effects such control to output the potential of a constant level. According to the arrangement, the precharge circuit operates only during the precharge period and thereby reduces power consumption as compared with a precharge circuit that operates with the same results, but throughout the time.

Preferably, each of the foregoing precharge control circuits includes a level shifter circuit (5, 5*a*, 5*b*, 51), which is activated during a period in which an input of the low-amplitude external input signal is required, for level-shifting the low-amplitude external input signal.

In this event, the level shifter circuit becomes active during the precharge period and the period during which an input of the low-amplitude external input signal is required; therefore, it is ensured that the precharging is controllable only during the precharge period based on the external input signal with an amplitude lower than that of the drive voltage of the precharge circuit.

Meanwhile, as detailed so far, another precharge circuit in accordance with the present invention is for precharging a signal line to which a signal voltage indicative of contents of a signal is intermittently applied up to a predetermined precharge voltage before the signal voltage is applied, the precharge circuit including a precharge control circuit for monitoring a precharge control signal representative of a precharge period specified outside a period during which the signal voltage is applied, so as to effect such control that the precharge voltage is output to the signal line during the precharge period, wherein:

the precharge control circuit controls output of the precharge voltage based on an externally supplied, low-amplitude external input signal, as the precharge control signal, which has a lower level than a drive signal level of the precharge circuit; and the precharge control circuit stops monitoring the low-amplitude external input signal at every interval between precharge periods, based on an input signal that has a substantially identical level with the drive signal level and that is in synchronism with time when the precharge control signal is applied or the signal voltage is applied.

According to the arrangement, the precharge control circuit determines every interval between precharge periods based on an input signal in synchronism with either an application timing of the precharge control signal or an application timing of the signal voltage, for example, based on the signal line selection signals SO1 to SOi and SOd, stops the input circuit, for example, the level shift circuit, for monitoring the low-amplitude external input signal at every interval between precharge periods, and resumes the operation of the input circuit at or before the start of a succeeding precharge period.

Here, an input circuit to which a signal is supplied at a level which differs from the original drive signal level is likely to have a complicating circuit arrangement and consumes relatively large power. Therefore, such an input circuit, if operating throughout the time, might consume an increased amount of power. However, according to the arrangement, the input circuit is stopped at every interval between precharge periods, and thereby reduces power consumption in the precharge circuit as compared with a precharge circuit in which the input circuit in the precharge control circuit operates throughout the time with the same results as the precharge circuit.

Additionally, the input signal has a substantially same level as the drive signal level and can drive those elements in the precharge circuit without being level-shifted by the level shift circuit. Therefore, the precharge control circuit can control the start and end of the operation of the input circuit without a circuit to which an input signal is supplied at a different level, such as another level shift circuit, to stop the operation of the input circuit.

Preferably, each of the foregoing precharge control circuits further includes a latch circuit (4, 4*a*, 4*a*, 4*b*) for holding a signal which becomes active during an active period of the precharge circuit; and the level shifter circuit is controlled based on an output of the latch circuit.

In this case, no dedicated circuit needs to be separately provided to produce an input signal of the latch circuit, but a signal in synchronism with the precharge period can be used as that input signal, which renders the arrangement simple accordingly. Further, if such a signal in synchronism with the precharge period already exists in the system to which the precharge circuit is mounted, the signal can play a double role, allowing the precharge circuit to be controlled through an existent input terminal and input signal in the system.

Preferably, the level shifter circuit is of a current drive type. Level shifter circuits can be roughly divided into two major categories: voltage drive types and current drive types. A voltage drive type does not require a constant current and therefore can cut down on power consumption. However, its operation is largely affected by threshold values of the switching elements included in the circuit, and the operation margin for switching element characteristics is narrow. In contrast, a current drive type requires a constant current and therefore has a disadvantage of relatively large power consumption. However, it has an advantage of a wide operation margin for the characteristics of the switching elements included in the circuit. For instance, if the switching element is made incorporating a polycrystalline silicon thin film transistor, the polycrystalline properties render it difficult to impart uniform threshold values and movability to all the transistors in the circuit. A level shifter circuit of a current drive type offers a wide operation margin and thereby solve these problems.

Figure 32:
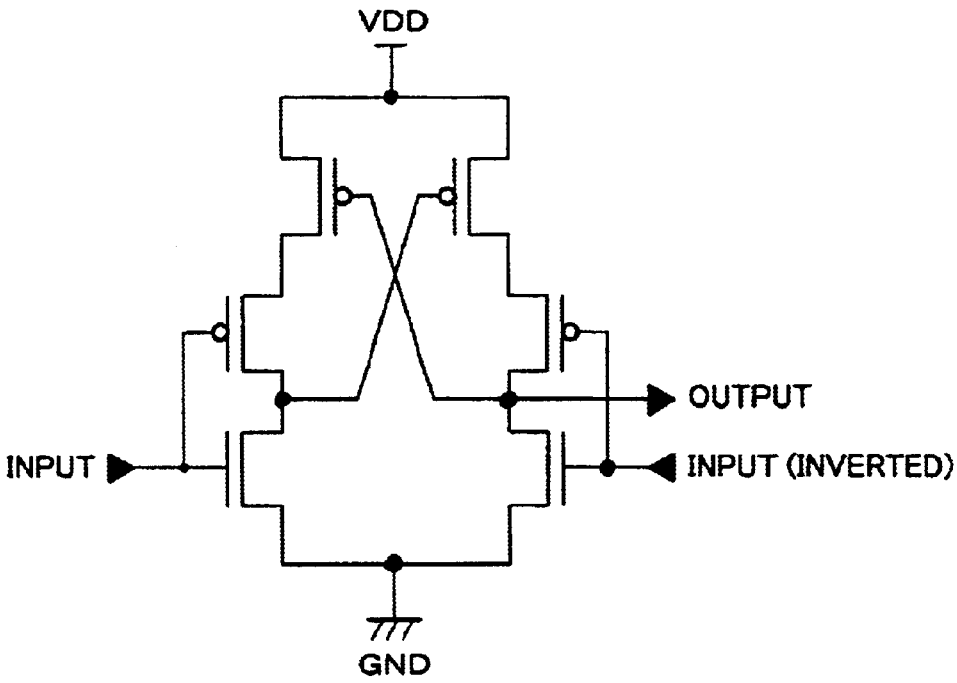
FIG. 32 is a block diagram showing, as an example, an arrangement of a level shifter circuit of a voltage drive type.
Figure 33:
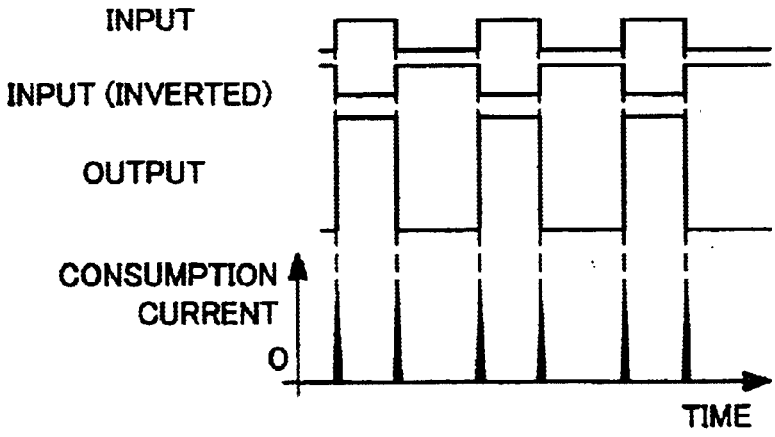
FIG. 33 is a drawing showing, as an example, timings of operations and power consumption of the level shifter circuit of a voltage drive type of FIG. 32.
Figure 34:
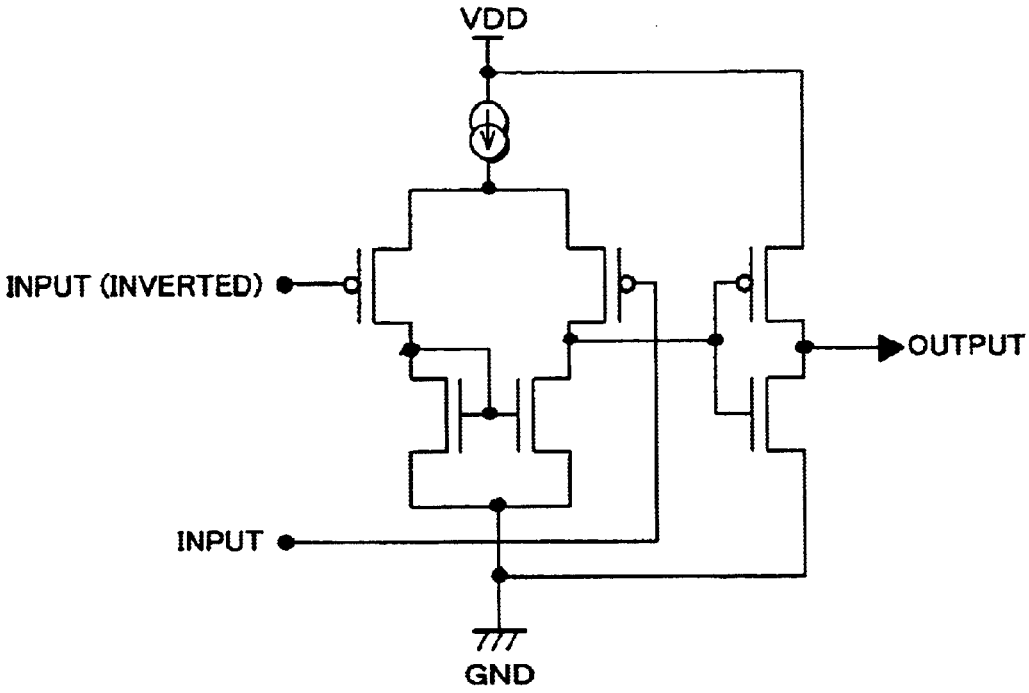
FIG. 34 is a drawing showing, as an example, an arrangement of a level shifter circuit of a current drive type.
Figure 35:
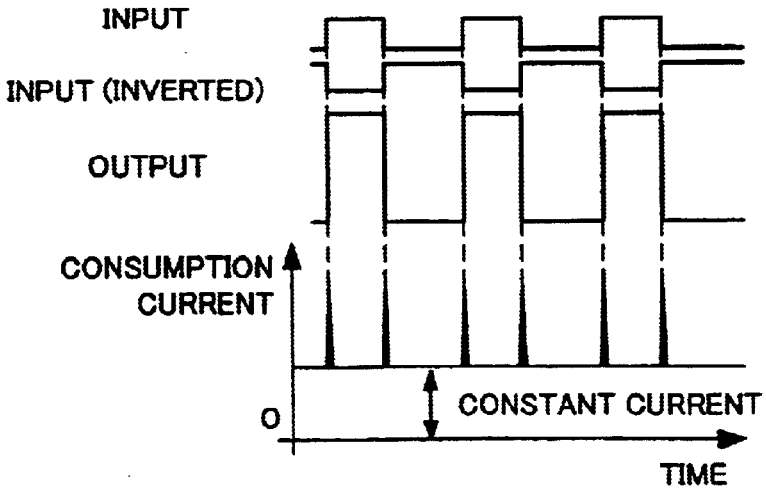
FIG. 35 is a drawing showing, as an example, timings of operations and power consumption of the level shifter circuit of a current drive type of FIG. 34.
Figure 36:
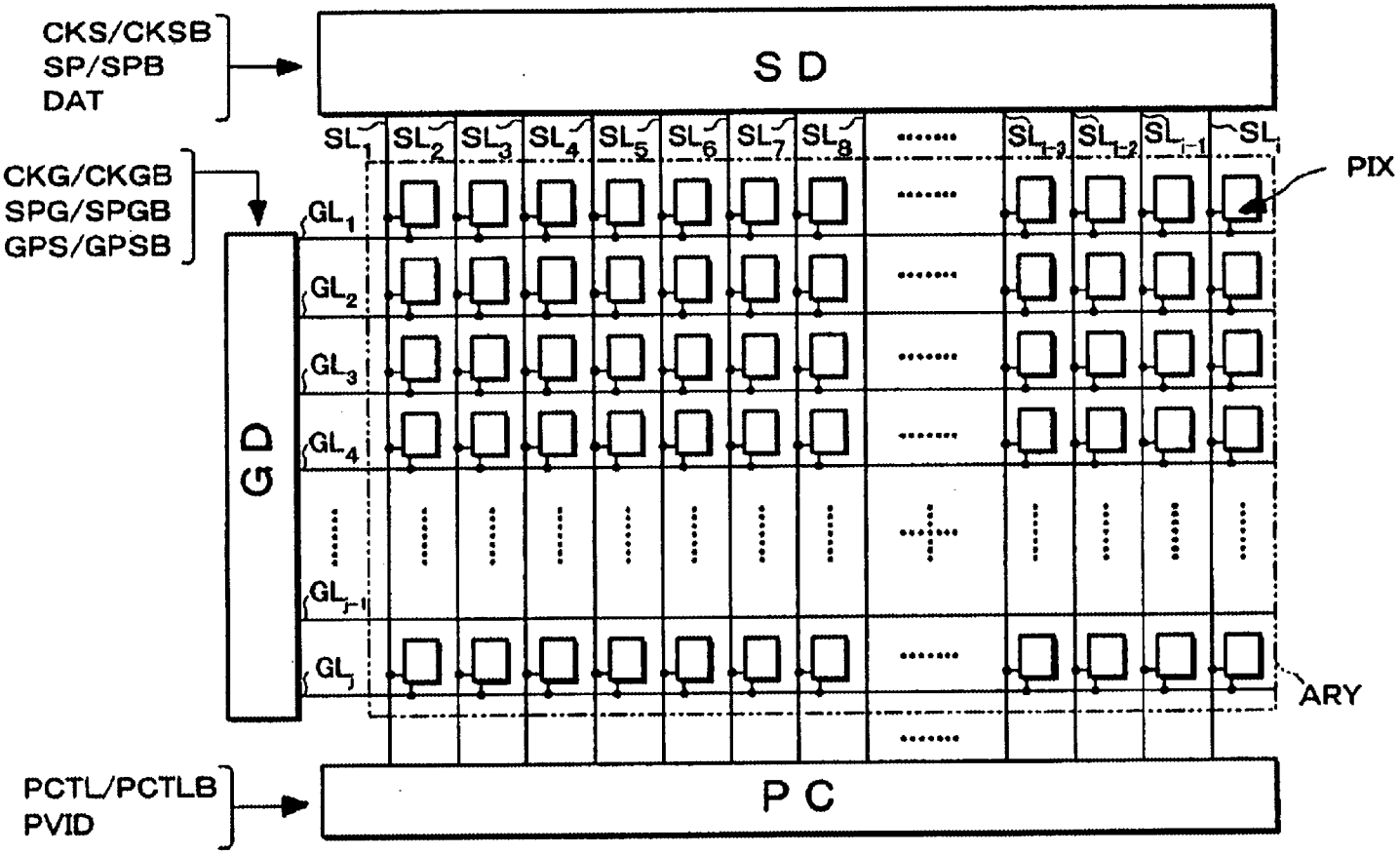
FIG. 36 is a block diagram showing, as an example, an arrangement of a conventional image display device.

More specifically, the level shifter circuit of a voltage drive type is represented by the 6-transistor level shifter shown in FIG. 32. This type does not require a constant current and therefore boasts low power consumption, as can be seen from FIG. 33 showing its properties in input, output, and current consumption. However, its operation speed is strongly dictated by threshold values of the transistors included in the circuit, and the operation margin for transistor characteristics is narrow. The level shifter circuit of a current drive type is represented by the differential amplifier circuit shown in FIG. 34. As can be seen from FIG. 35 showing its properties of input, output, and current consumption, this type requires a constant current and therefore has a disadvantage of relatively large power consumption. However, it has an advantage of a wide operation margin for the characteristics of the transistors included in the circuit. The level shifter circuit of a current drive type, if used as the level shifter circuit in the precharge circuit, offers a wide operation margin with increases in power consumption.

Preferably, the latch circuit is a set-reset flip-flop (4) such that a set signal has a pulse which is in synchronism with a start timing of the active period of the precharge circuit and whose width is equal to or shorter than the active period of the precharge circuit, that the level shifter circuit is maintained in an active state during the precharge period, and that a reset signal is in synchronism with an end timing of the active period of the precharge circuit and does not overlap with the set signal.

In this case, upon receiving a set signal, the set-reset flip-flop changes its output from a non-active state to an active state. Upon receiving a reset signal, the set-reset flip-flop changes its output signal from an active state to a non-active state and maintains the output in that state. This enables control of the precharging.

Preferably, the latch circuit is a set-overwrite-reset flip-flop (4*a*) such that a set signal has a pulse which is in synchronism with a start timing of the active period of the precharge circuit, whose width is equal to or shorter than the active period of the precharge circuit, and which overlaps with an active period of a low-amplitude external input signal level-shifted by the level shifter circuit, that the level shifter circuit is maintained in an active state during the active period of the precharge circuit, and that a reset signal is an inverted signal of an output of the level shifter circuit.

In this case, upon receiving a set signal, the set-overwrite-reset flip-flop changes its output from a non-active state to an active state. Further, since the output of the level shifter circuit is used as the reset signal, self-resetting is carried out, and the set-overwrite-reset flip-flop changes its output from an active state to a non-active state and maintains the output in that state. This enables control of the precharging.

Preferably, the latch circuit includes first and second set-overwrite-reset flip-flops (4*a*, 4*b*);

the level shifter circuit of a current drive type includes first and second level shifter circuits (5*a*, 5*b*) controlled respectively by the first and second set-overwrite-reset flip-flops;

the first set-overwrite-reset flip-flop uses as a set signal a signal that becomes active in synchronism with a start timing of an active period of the precharge circuit and that becomes non-active either before an output signal of the second level shifter circuit becomes active or when the output signal is active and uses as a reset signal an output signal of the second set-overwrite-reset flip-flop; and the second set-overwrite-reset flip-flop uses as a set signal an output signal of the first level shifter circuit and uses as a reset signal an inverted signal of an output signal of the second level shifter circuit.

In this case, the set signal needs to be externally supplied only to the first set-overwrite-reset flip-flop. The reset signal of the first set-overwrite-reset flip-flop, the set and reset signals of the second set-overwrite-reset flip-flop can be supplied within the precharge control circuit. Therefore, the arrangement becomes simple accordingly.

Preferably, the precharge voltage is of an opposite polarity to that of a video signal during an immediately preceding horizontal or vertical period and has a predetermined offset value. In this event, the precharge voltage falls to the polarity of the immediately preceding horizontal or vertical period due to the coupling to the data signal line. Insufficiency in charging, if any, can be compensated for by the offset so that the output voltage converges at a predetermined precharge voltage.

Preferably, an image display device includes any one of the foregoing precharge circuits. In this case, by causing the precharge circuit to operate only during chosen periods, power consumption in the image display device can be reduced.

Preferably, the precharge circuit is provided on the same substrate as (i) pixels (PIX) surrounded by the signal lines and scan lines and arranged in a matrix form and (ii) the signal line drive circuit (SD) and a scan line drive circuit (GD) for driving the pixels. In this case, the pixels for effecting a display, the signal line drive circuit and scan line drive circuit for driving the pixels, and the precharge circuit can be fabricated on the same substrate by common steps, which allows manufacturing and packaging costs to be reduced and the ratio of items conforming to packaging standards to be improved.

Preferably, the active elements included in the precharge circuit and the pixels are all fabricated each including a polycrystalline silicon thin film transistor.

In this case, in comparison to the precharge circuit and the pixels fabricated including amorphous silicon thin film transistors, extremely high driving capabilities become available. Therefore, the pixels, the signal line drive circuit, and the precharge circuit can be readily formed on a single substrate. In addition, the polycrystalline silicon thin film transistor, as compared to the monocrystalline silicon thin film transistor, does not exhibit uniform electrical characteristics; therefore, the level shifter circuit used is typically of a current drive type which ensures a wide margin for transistor characteristics. A likely result is increases in power consumption due to the current drive. However, according to the invention, the current necessary in the level shifter circuit of a current drive type can be limited to flow only during chosen periods as mentioned earlier. Therefore, the circuit operates in a satisfactory manner at restrained power consumption.

Preferably, the polycrystalline silicon thin film transistor is fabricated on a glass substrate at process temperatures equal to, or below, 600° C. In this case, the substrate can be fabricated from glass which, although having a low distortion temperature, is inexpensive and easy to manufacture in large dimensions. A wider range of selections is thereby available for substrate material, and an image display device can be manufactured with a large screen area at low cost.

From the foregoing, the precharge circuit in accordance with the present invention incorporates therein a precharge control circuit for controlling the operation of the precharge circuit and can restrain the power consumption in the precharge circuit by causing the precharge circuit including a low-voltage interface using a level shifter of a current drive type to operate in a limited time.

Further, the image display device using the precharge circuit offers a low power consuming, low-voltage interface and thereby reduces the amplitude of an input logic signal, therefore reducing the load on an external components, such as a controller IC, without causing a degradation in image quality.

Especially when the precharge circuit is fabricated on the same substrate by means of use of polycrystalline silicon thin film transistors, to offer a low-voltage interface, a level shifter circuit of a current drive type which provides a wide operating margin for transistor characteristics must be used because of their inferior properties to those of monocrystalline silicon transistors. For this reason, the advantages in using the precharge circuit in accordance with the present invention are very much appreciated in view of its low power consumption.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A precharge circuit for precharging a signal line to a predetermined voltage before applying a video signal to the signal line, comprising:

a precharge control circuit which operates during a shorter period, encompassing a precharge period in horizontal blanking period in a horizontal period, not coinciding with a drive period of the signal line than an effective display period in a horizontal period and which effects such control to output the predetermined voltage;

wherein:

the precharge control circuit is further configured to control the selective operation of the precharge circuit based on an externally supplied, low-amplitude external input signal which has an amplitude lower than that of a drive voltage of the precharge circuit and to maintain the amplitude during the precharge period, the precharge control circuit includes a level shifter circuit for level-shifting the low-amplitude external input signal, and the precharge control circuit being configured to control the level shifter circuit so as to be activated during a period in which an input of the low-amplitude external input signal is required.

2. The precharge circuit as defined in claim 1, wherein:

the level shifter circuit is of a current drive type.

3. The precharge circuit as defined in claim 2, wherein:

the level shifter circuit includes a differential input pair for comparing the low-amplitude external input signal with an inverted signal thereof and a current source for supplying a current to the differential input pair;

the precharge control circuit is further configured to control the level shifter circuit so as to cut off the current supply by the current source during a non-active period of the level shifter circuit.

4. The precharge circuit as defined in claim 3, wherein:

the level shifter circuit includes a switch provided between the differential input pair and a power supply line; and the precharge control circuit is further configured to open the switch to cut off a current path originating at the current source and leading through the differential input pair to the power supply line.

5. The precharge circuit as defined in claim 4, wherein:

the level shifter circuit includes a blocking circuit for applying a blocking potential to both control terminals of the differential input pair; and the precharge control circuit is further configured to control the blocking circuit so as to apply the blocking potential during a non-active period of the level shifter circuit.

6. The precharge circuit as defined in claim 2, wherein:

the precharge circuit is fabricated including a polycrystalline silicon thin film transistor.

7. The precharge circuit as defined in claim 1, wherein:

the precharge control circuit further includes a latch circuit for holding a signal which becomes active during an active period of the precharge circuit; and the level shifter circuit is controlled based on an output of the latch circuit.

8. The precharge circuit as defined in claim 7, wherein:

the latch circuit is a set-reset flip-flop such that a set signal has a pulse which is in synchronism with a start timing of the active period of the precharge circuit and whose width is equal to or shorter than the active period of the precharge circuit, that the level shifter circuit is maintained in an active state during the precharge period, and that a reset signal is in synchronism with an end timing of the active period of the precharge circuit and does not overlap with the set signal.

9. The precharge circuit as defined in claim 7, wherein:

the latch circuit is a set-overwrite-reset flip-flop such that a set signal has a pulse which is in synchronism with a start timing of the active period of the precharge circuit, whose width is equal to or shorter than the active period of the precharge circuit, and which overlaps with an active period of a low-amplitude external input signal level-shifted by the level shifter circuit, that the level shifter circuit is maintained in an active state during the active period of the precharge circuit, and that a reset signal is an inverted signal of an output of the level shifter circuit.

10. The precharge circuit as defined in claim 7, wherein:

the latch circuit includes first and second set-overwrite-reset flip-flops;

the level shifter circuit of a current drive type includes first and second level shifter circuits controlled respectively by the first and second set-overwrite-reset flip-flops;

the first set-overwrite-reset flip-flop uses as a set signal a signal that becomes active in synchronism with a start timing of an active period of the precharge circuit and that becomes non-active either before an output signal of the second level shifter circuit becomes active or when the output signal is active and uses as a reset signal art output signal of the second set-overwrite-reset flip-flop; and the second set-overwrite-reset flip-flop uses as a set signal an output signal of the first level shifter circuit and uses as a reset signal an inverted signal of an output signal of the second level shifter circuit.

11. A precharge circuit for precharging a signal line to a predetermined voltage before applying a video signal to the signal line, wherein a drive circuit for apply the video signal to the signal line is capable of driving the signal line in both directions, said precharge circuit comprising:

a precharge control circuit which operates during a shorter period, encompassing a precharge period not coinciding with a drive period of the signal line, than an effective display period in a horizontal period and which effects such control to output the predetermined voltage; and wherein the precharge circuit is provided with a precharge voltage producing circuit for giving an offset to, and thereby moving, the precharge voltage off a predetermined reference value in a direction in which a driving capability is smaller than in the other direction, based on a correction signal in accordance with a difference between a current driving capability with which the drive circuit drives the signal line in one of the directions and a current driving capability with which the drive circuit drives the signal line in the other direction.

12. A precharge circuit for precharging a signal line to which a signal voltage indicative of contents of a signal is intermittently applied up to a predetermined precharge voltage before the signal voltage is applied, the precharge circuit comprising a precharge control circuit for monitoring a precharge control signal representative of a precharge period specified outside a period during which the signal voltage is applied, so as to effect such control that the precharge voltage is output to the signal line during the precharge period, wherein:

the precharge control circuit controls output of the precharge voltage based on an externally supplied, low amplitude external input signal, as the precharge control signal, which has a lower level than a drive signal level of the precharge circuit; and the precharge control circuit stops monitoring the low-amplitude external input signal at every interval between precharge periods, based on an input signal that has a substantially identical level with the drive signal level and that is in synchronism with time when the precharge control signal is applied or the signal voltage is applied.

13. A precharge circuit for precharging a signal line to a predetermined voltage before applying a video signal to the signal line, said precharge circuit comprising:

a precharge control circuit which operates during a shorter period, encompassing a precharge period not coinciding with a drive period of the signal line, than an effective display period in a horizontal period and which effects such control to output the predetermined voltage, the precharge control circuit controlling the precharging based on an externally supplied, low-amplitude external input signal which has an amplitude lower than that of a drive voltage of the precharge circuit and maintains the amplitude during the precharge period;

wherein the precharge control circuit includes:

a level shifter circuit for level-shifting an externally supplied, low-amplitude external input signal which has an amplitude lower than that of a drive voltage of the precharge circuit, and a latch circuit for holding a signal which becomes active during an active period of the precharge circuit, the level shifter circuit being controlled based on an output of the latch circuit;

wherein the precharge control circuit is configured to control the level shifter circuit so as to be activated during a period in which an input of the low-amplitude external input signal is required; and wherein the latch circuit is a set-reset flip-flop such that a set signal has a pulse which is in synchronism with a start timing of the active period of the precharge circuit and whose width is equal to or shorter than the active period of the precharge circuit, that the level shifter circuit is maintained in an active state during the precharge period, and that a reset signal is in synchronism with an end timing of the active period of the precharge circuit and does not overlap with the set signal.

14. A precharge circuit for precharging a signal line to a predetermined voltage before applying a video signal to the signal line, said precharge circuit comprising:

a precharge control circuit which operates during a shorter period, encompassing a precharge period not coinciding with a drive period of the signal line, than an effective display period in a horizontal period and which effects such control to output the predetermined voltage, the precharge control circuit controlling the precharging based on an externally supplied, low-amplitude external input signal which has an amplitude lower than that of a drive voltage of the precharge circuit and maintains the amplitude during the precharge period;

wherein the precharge control circuit includes:

a level shifter circuit for level-shifting an externally supplied, low-amplitude external input signal which has an amplitude lower than that of a drive voltage of the precharge circuit, and a latch circuit for holding a signal which becomes active during an active period of the precharge circuit, the level shifter circuit being controlled based on an output of the latch circuit;

wherein the precharge control circuit is configured to control the level shifter circuit so as to be activated during a period in which an input of the low-amplitude external input signal is requited; and wherein the latch circuit is a set-overwrite-reset flip-flop such that a set signal has a pulse which is in synchronism with a start timing of the active period of the precharge circuit, whose width is equal to or shorter than the active period of the precharge circuit, and which overlaps with an active period of a low-amplitude external input signal level-shifted by the level shifter circuit, that the level shifter circuit is maintained in an active state during the active period of the precharge circuit, and that a reset signal is an inverted signal of an output of the level shifter circuit.

15. A precharge circuit for precharging a signal line to a predetermined voltage before applying a video signal to the signal line, said precharge circuit comprising:

a precharge control circuit which operates during a shorter period, encompassing a precharge period not coinciding with a drive period of the signal line, than an effective display period in a horizontal period and which effects such control to output the predetermined voltage, the precharge control circuit controlling the precharging based on an externally supplied, low-amplitude external input signal which has an amplitude lower than that of a drive voltage of the precharge circuit and maintains the amplitude during the precharge period;

wherein the precharge control circuit includes:

a level shifter circuit for level-shifting an externally supplied, low-amplitude external input signal which has an amplitude lower than that of a drive voltage of the precharge circuit, and a latch circuit for holding a signal which becomes active during an active period of the precharge circuit, the level shifter circuit being controlled based on an output of the latch circuit;

wherein the precharge control circuit is configured to control the level shifter circuit so as to be activated during a period in which an input of the low-amplitude external input signal is required;

wherein the latch circuit includes first and second set-overwrite-reset flip-flops;

wherein the level shifter circuit of a current drive type includes first and second level shifter circuits controlled respectively by the first and second set-overwrite-reset flip-flops;

wherein the first set-overwrite-reset flip-flop uses as a set signal a signal that becomes active in synchronism with a start timing of an active period of the precharge circuit and that becomes non-active either before an output signal of the second level shifter circuit becomes active or when the output signal is active and uses as a reset signal an output signal of the second set-overwrite-reset flip-flop; and wherein the second set-overwrite-reset flip-flop uses as a set signal an output signal of the first level shifter circuit and uses as a reset signal an inverted signal of an output signal of the second level shifter circuit.

* * * * *